US006911958B2

(12) United States Patent
Swarup et al.

(10) Patent No.: US 6,911,958 B2
(45) Date of Patent: Jun. 28, 2005

(54) PRELOADED PARABOLIC DISH ANTENNA AND THE METHOD OF MAKING IT

(75) Inventors: Govind Swarup, Maharashna (IN); Suresh Chandra Tapde, Maharashtra (IN)

(73) Assignee: Tata Institute of Fundamental Research (IN)

( * ) Notice: Subject to any disclaimer, the term of this patent is extended or adjusted under 35 U.S.C. 154(b) by 0 days.

(21) Appl. No.: 10/333,967

(22) PCT Filed: Jul. 30, 2001

(86) PCT No.: PCT/IN01/00137

§ 371 (c)(1),
(2), (4) Date: Jan. 24, 2003

(87) PCT Pub. No.: WO02/13314

PCT Pub. Date: Feb. 14, 2002

(65) Prior Publication Data

US 2004/0027309 A1 Feb. 12, 2004

(30) Foreign Application Priority Data

Aug. 1, 2000 (IN) ..... 721/2000

(51) Int. Cl.[7] ..... H01Q 15/14; H01Q 1/12
(52) U.S. Cl. ..... 343/912; 343/878
(58) Field of Search ..... 343/912, 915, 343/840, 878, 885, 916

(56) References Cited

U.S. PATENT DOCUMENTS 2,985,881 A * 5/1961 Holland et al. ..... 343/912
4,845,511 A * 7/1989 Grayson et al. ..... 343/915
5,104,211 A * 4/1992 Schumacher et al. ..... 359/853
5,247,312 A * 9/1993 McClendon ..... 343/840

* cited by examiner

*Primary Examiner*—Hoang V. Nguyen
(74) *Attorney, Agent, or Firm*—Pendorf & Cutliff

(57) ABSTRACT

The back-up structure of a parabolic dish antenna, which supports its reflecting surface, is formed in this invention by preloading its radial and circumferentially placed straight structural members and hence it is termed as preloaded parabolic dish antenna. Such a preloading results in considerable reduction in its weight and also to the effort involved in its assembly. The back-up structure of the preloaded parabolic dish antenna is made of a central hub, an assembly of a suitable number of elastically bent radial structural members connected rigidly to the central hub and to the same number of straight structural members which are connected to the tips of the radial members at the outer rim of the dish and also to straight bracing members placed circumferentially at intermediate locations, which are all tensioned to specified prestress values in the absence of wind loading. The outermost rim members placed at the periphery of the dish form the aperture of the dish. The backup structure of the preloaded parabolic dish antenna is given the parabolic shape by fixing the radial members at a suitable inclination angle and location at the hub and by applying an appropriate force with a normal component at their tips so as to bend the radial members elastically such that their curvature becomes approximately the same as that of the parabolic curve between the hub and the peripheral rim point. The invention incorporates a suitable rigid connection of the elastically bent radial members and other structural members in order to store sufficient initial elastic energy in the back-up structure of the dish for resisting gravitational and static and dynamic wind forces on the parabolic dish antenna for the survival wind condition at the antenna site. This configuration also reduces moment of the wind forces and torques on the mounting tower and gear drive system of the dish antenna. This invention is also applicable to structures of geometries other than that of the parabolic dishes. The method of constructing the preloaded parabolic dish and attaching reflector panels of lightweight is also disclosed.

The preloaded parabolic dish antennas are useful in microwave communication, satellite communication, radar, radio telescope and other similar applications for receiving and/or transmitting radio waves.

16 Claims, 18 Drawing Sheets

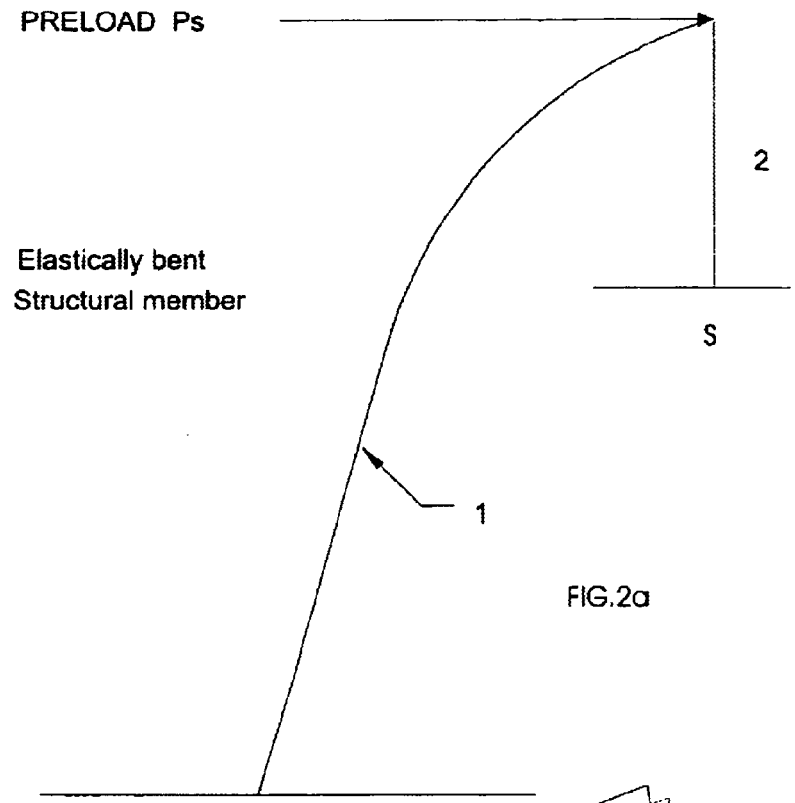
FIG.2a
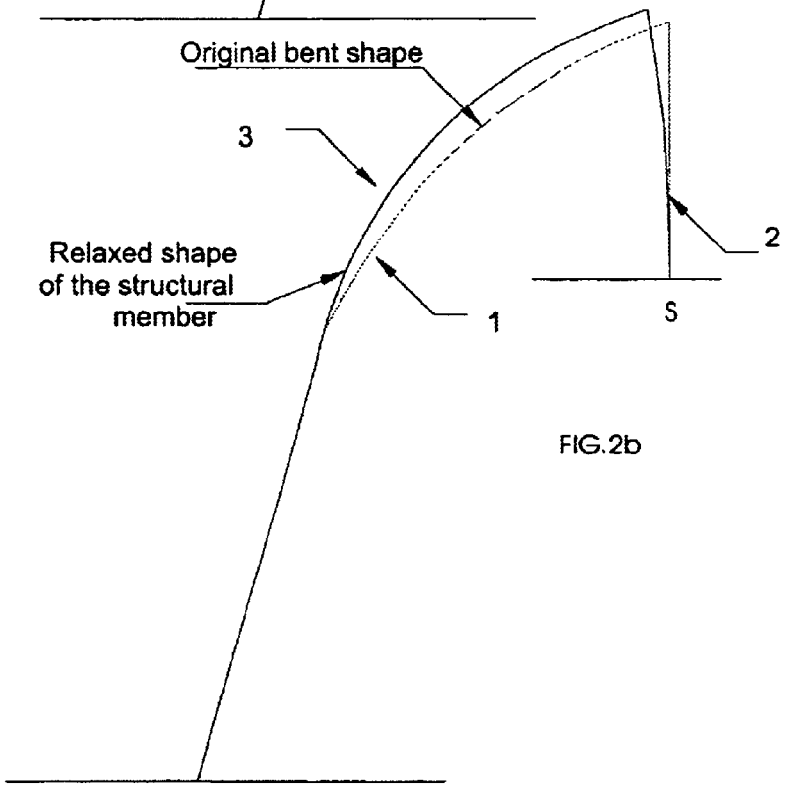
FIG.2b
FIG.2

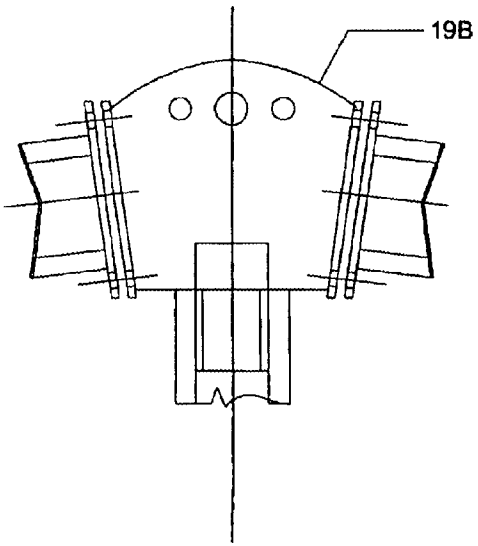
FIG.11B
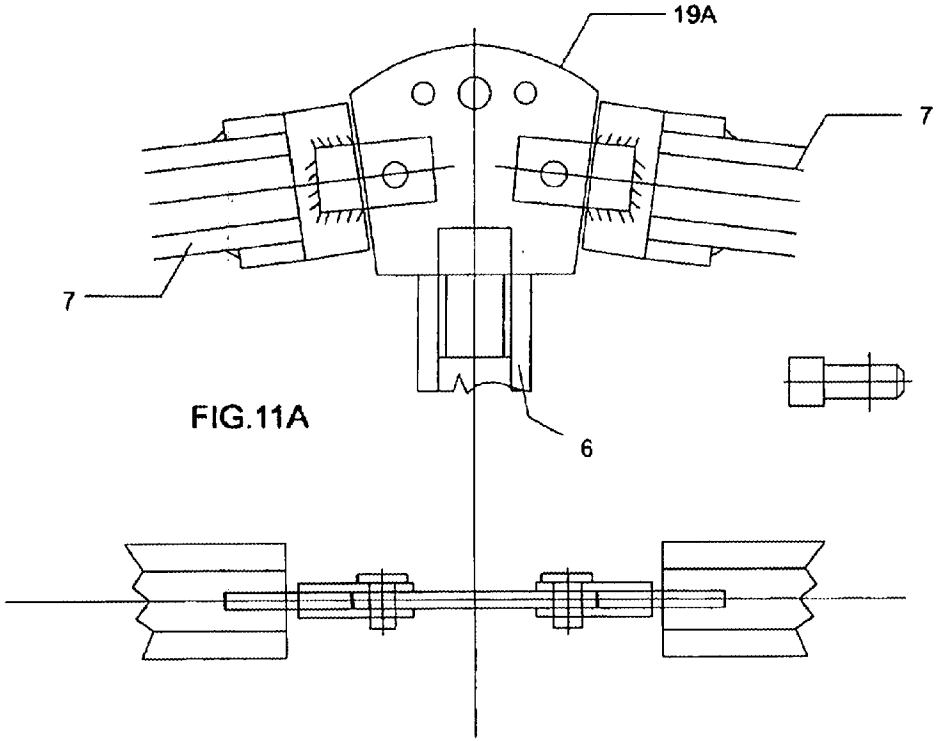
FIG.11A
FIG.11

PRELOADED PARABOLIC DISH ANTENNA AND THE METHOD OF MAKING IT

CROSS REFERENCE TO RELATED APPLICATION

This application is a national stage of PCT/IN01/00137 filed Jul. 30, 2001 and based upon INDIA 721/MUM/2000 filed Aug. 1, 2000 under the International Convention.

FIELD OF INVENTION

This invention relates to parabolic dish antennas used in microwave communication, satellite communication, radars, radio telescopes and in other applications. This invention also relates to the fabrication of such parabolic dish antennas. More particularly the invention relates to parabolic dish antennas having diameter in the range of about 5 m to 100 m.

OBJECT OF THE INVENTION

The principal object of the present invention is to provide an improved back-up structure for parabolic dish antennas which is light in weight and has lower overall cost.

It is a further object of the invention to provide a method of fabrication of the back-up structure of parabolic dish antennas by preloading its structural members such that the assembly has reduced weight.

It is another object of the invention to provide an improved back-up structure for parabolic dish antennas having diameter in the range of about 5 m to 100 m which have high initial elastic strain energy resulting in greater resistibility to gravitational and static and dynamic wind forces.

It is a still further object of the invention to provide a parabolic dish antenna supported on the improved back-up structure and which allows operation at a frequency in the range of about 100 MHz to 22 GHz being particularly suitable for radio astronomical observations.

BACKGROUND AND PRIOR ART

Parabolic dishes are also useful for UHF and Microwave Communication, Satellite Communication, Troposcatter Communication, Radars and similar applications for receiving and/or transmitting radio signals.

A parabolic dish antenna consists of a metallic or metallized paraboloidal reflecting surface, which is supported by a back-up-structure. Radio waves from a distant radio source or a radio transmitter, are reflected by the paraboloidal reflector surface and are concentrated at the focal point of the dish antenna, where they are received by a primary antenna feed and an amplifier unit. Similarly for a transmitting antenna, radio waves from a transmitter are applied to the antenna-feed and are reflected by the parabolic dish to a far away distance.

The reflector surface of the parabolic dish antennas consists of a number of plane or curved panels, made out of metal or metallized sheets or wire mesh, which are supported by a back-up-structure. The reflecting surface, the back-up-structure and a supporting structure for the antenna feed form the main elements of the parabolic dish antenna. The dish antenna is placed on a fixed or a mechanically driven mount which allows its pointing to different directions of the sky.

Conventionally the back-up-structure of the parabolic dish antenna consists of a large number of curved radial trusses made of structural members, which are interconnected using diagonal bracings and circumferential structural members in order to achieve a 3-dimensional paraboloidal shaped back-up structure (see references cited below). Sometimes a 3-dimensional space-frame configuration is used for the radial, circumferential and bracing members of the back-up-structure made of materials such as steel or aluminum and its alloys, or carbon-fibre tubes. The structural members are welded or riveted or bolted or joined together suitably in order to provide rigidity. Typical examples of back-up structure of some parabolic dish antennas using prior art are shown in FIG. 1 in the accompanying drawings.

The sizes and strength of the materials of the structural members of the parabolic dish antennas are chosen for resisting gravitational and wind forces. In particular, it is required that the tensile and compressive stresses in the structural members of the dish antenna should be within the bounds, as per the national or international structural design codes for the specified survival wind velocity. Conventional parabolic dish antennas or reflector antennas are described in the literature such as:

References to Literature i) Baars, J. W. M., Brugge, J. F. van der, Casse, J. L., Hamaker, J. P., Sondar, L. H., Visser, J. J. and Willington, K. J. The Synthesis Radio Telescope at Westerbork, Proc. IEEE, Vol. 61, 1258–1266, 1973.

ii) Goldsmith, P. F.,(eds.), "Instrumentation and Techniques for Radio Astronomy: Part-I: Filled Aperture Antennas", pp. 17–89, IEEE Press, New York, 1988.

iii) Hoemer, van, S., Design of Large steerable Antennas, Astron. J., vol. 72, pp. 35–47, 1967.

iv) Hooghoudt, B. G., The Benelux Cross Antenna, Ann. N.Y. Acad. Sci., vol 116(1), p.13–24, 1964.

v) Love, A. W., Some Highlights in Reflector Antenna Development in "Reflector Antennas", Love, A. W., ed., IEEE Press, New York, 1978.

vi) Mar J. W. & Libowitz, K (eds.) "Structure Technology for Large Radio and Radar Telescope Systems" MIT Press, Cambridge 1969.

vii) McAlister, K. R., and Lbum, N. F, The Culgoora Radio Heliograph—The Aerials, Proc. Inst. Radio & Electronics Engrs. Australia, vol. 28, pp. 291–297, 1967.

viii) Schneider, K., and Schonbach, W., 25 m Communication Antenna at Raisting, "Design & Construction of Large Steerable Aerials", pp. 242–246, IEE Conf. Pub. No.21, Inst. Electronic Engineering, UK.

ix) Swarup, G., Ananthakrishnan, S., Kapahi, V. K., Rao, A. P., Subrahmanya, C. R., and Kulkarni, V. K., The Giant Metrewave Radio Telescope, Current Science, vol.60, pp. 95–105, 1991.

U.S. Pat. No. 3,762,207 (Weiser) teaches a method of Fabricating Curved Surface.

U.S. Pat. No. 4,001,836 (Archer) teaches parabolic dish and method of constructing same.

U.S. Pat. No. 4,378,561 also relates to parabolic reflector antenna.

U.S. Pat. No. 4,568,945 (Winegard) teaches satellite dish antenna apparatus.

U.S. Pat. No. 4,710,777 (Halverson) deals with dish antenna structure.

U.S. Pat. No. 4,731,617 (Gray) relates to apparatus and method for making paraboloidal surface.

U.S. Pat. No. 4,860,023 (Halm) teaches parabolic reflector antenna and method of making same.

U.S. Pat. No. 5,446,474 (Wade) deals with redeployable furlable rib reflector.

French Patent 9,203,506 (corresponding to U.S. Ser. No. 08/035,315) (Rits) relates to collapsible Rib Tensioned Surface (CRTS) Reflector for VLBI Applications.

The conventional design of the back-up-structure of parabolic dish antennas as described in the literature becomes quite complex for large diameter parabolic dishes as can be seen from FIG. 1. The conventional design leads to increased weight of the structural members and also requires considerable amount of welding or bolting. Also the required curvature of both the radial and circumferential members is made by rolling or bending in a suitable machine which is labour intensive.

SUMMARY OF THE INVENTION

Thus the present invention relates to an improved back-up structure for parabolic dish antenna, said back-up structure comprising:

a central hub;

an assembly of plurality of elastically bent radial structural members connected to the central hub on one end and spreading out radially from the hub, in an umbrella-like configuration, and extending to a nearly circular rim at the end away from the hub;

a plurality of straight structural rim members connected rigidly to the radial members towards the rim end thereof;

a plurality of bracing members disposed at intermediate locations on the radial structural members between the hub and rim ends, said bracing members being substantially parallel to the structural rim members;

each of said members being tensioned to specified prestress values in the absence of wind loading.

The invention also relates to a method of fabrication of the back-up structure described in the last preceding paragraph, the method comprising:

providing a central hub;

providing predetermined radial structural members by bending structural members elastically to a predetermined curvature;

connecting the radial structural members to the central hub so as to form a supporting structure for the reflecting surface of a parabolic dish antenna; said radial structural members extending from the hub end to the rim end;

connecting same numbers of straight structural rim members as the number of radial members at their tips along the rim end of the radial members;

connecting structural bracing members at intermediate locations on the radial structural members between the hub and the rim end, the said bracing members being positioned parallel to the said structural rim members;

each said structural member having been subjected to initial prestress of such order that the stress values, in tension or compression lie within the allowable stress values as per the national structural codes, under conditions of maximum expected wind velocity during the estimated lifetime of the structure as well as that of the parabolic dish to be assembled thereof.

According to a further aspect of the invention there is provided a preloaded parabolic dish antenna comprising:

(a) a back-up structure described hereinabove (b) a reflecting surface, said reflecting surface attached to the said radial structural members and being provided with metallic or metallized reflector panels of specified tolerances, and (c) a structure for supporting electronic units at the focus, (d) said parabolic dish having sufficient stiffness such that the lowest frequency of various vibrational modes exceeds about 1.5 or 2 Hz in order to provide safety in the presence of dynamic wind forces, such as gustiness of the wind.

According to another aspect of the invention there is provided a method for the fabrication of the preloaded parabolic dish antenna as described in the last preceding paragraph comprising:

(a) providing the back-up structure as described hereinabove (b) providing reflector panels having reflecting elements and attaching the said panels to the said radial structural members in order to thereby obtain a reflecting surface, said reflector panels being of predetermined tolerances, (c) providing a structure suitable for supporting electronic units at the focus to thereby obtain a parabolic dish antenna, (d) subjecting said parabolic dish to a suitable treatment so as to impart sufficient stiffness such that the lowest frequency of various vibrational modes exceeds about 1.5 or 2 Hz in order to provide safety in the presence of dynamic wind forces, such as gustiness of the wind.

The reflector panels used in the present invention are made of wire mesh attached to a structural frame with sufficiently high rigidity as well as tolerances so as to allow operation of the parabolic dish antenna up to a frequency of about 10 GHz.

The structure for supporting electronic units at the focus is preferably a quadripod structure.

The invention provides suitable curvature of the initially straight or slightly curved radial structural members of the parabolic dish by bending them elastically. By selecting a suitable geometry, the curvature of each of the elastically bent radial structural members is made approximately the same as the curvature of the required parabolic dish antenna at its location. The radial members are connected to a central hub at one end and are then bent elastically by applying a normal force at their tips. The elastically bent radial members are then connected rigidly to straight structural members placed near the periphery of the dish and at intermediate locations. All the members are joined together suitably in order to ensure that sufficient initial elastic strain energy is stored in them for enabling them to resist gravitational forces and static and dynamic wind forces on the parabolic dish antenna. It is preferred to use tubes for the structural members as tubes have lower value of drag co-efficient for the resulting wind force. Compared to the conventional practice, the present invention results in considerable reduction of the weight of the structural members of the parabolic dish antenna and also minimizes the effort involved in welding, bolting and assembly of the back-up structure of the dish antenna. Thus, the back-up structure of the parabolic dish gets considerably simplified which also results in reduction of the load, moments and torques due to gravitational wind forces on the mounting tower and the rotation axes of the parabolic dish antenna and its gear drive system.

The above configuration results in a "Preloaded Parabolic Dish" (PPD) Antenna. The preloaded concept is based on the principle that if a structure has an initial stored strain energy, then under certain conditions it has the capacity to offer a large stiffness to additional external loads. In the present invention this concept has been applied to the design of the backup support structure of a dish antenna in order to reduce its weight while retaining the originally required stiffness properties. In the preloaded parabolic dish several straight radial members are supported on a central hub and are bent by a normal force at their tips, which generates bending strain energy in each of the members. A large number of such members are bent and then connected to each other at the tip through stiff members which prevent the springback of the bent members. Thus, a skeleton of the bent radial members that are prestressed by the bending tip load, is obtained which resembles the configuration of a parabolic dish. The amount of bending (or the preload stress) is greater than or equal to the maximum stress that is expected to be carried by the radial members under the survival wind conditions. Such a structural configuration shows enhanced insensitivity to the external loads due to storage of internal strain energy. For obtaining additional rigidity against wind and gravitational forces and also vibrational instabilities, the radial members are also connected to one or more sets of bracing structural members at intermediate locations.

PREFERRED EMBODIMENT OF THE INVENTION

The required curvature of the elastically bent radial members can be made nearly the same as that of the parabolic curve of the dish antenna in a number of ways, for example (a) by means of fixing of the straight radial members at a suitable location at the central hub as well as inclination angle with respect to the plane of the central hub and then applying a force with a normal component at their tips for achieving the desired curvature and then connecting them rigidly to rim members forming a near circular (regular polygon) circumferntial ring; (b) by first prebending the radial members slightly to a curvature of relatively large radius and then fixing them at a suitable inclination angle and location at the central hub and then applying a force with a normal component at their tips for achieving the desired curvature; (c) by elastically bending the radial members firstly from the hub to an intermediate ring made of bracing members using suitable tensioning devices and then again from the intermediate ring to rim members forming a peripheral circumferntial ring.

Sufficient internal strain energy is stored in the structural members so that their stresses remain within the specified bounds as per the national codes for structures under conditions of a survival wind velocity by selecting appropriate diameter of the hub, number of radial members the dimensions, material and tensile strength of the radial, rim and bracing structural members and a suitable choice of the inclination angle of the radial members and their placement at the hub before their elastic bending. The required initial prestress is generated in the radial structural members by using one of the following methods:

(a) by means of tensioning devices using steel ropes and turnbuckles, connected to a temporarily erected ring-plate and/or a central tower with suitable attachments;

(b) by tensioning devices such as jacks placed near the tip of each of the radial members or pulling devices attached to the roof of a shed in case the dish is assembled in a shed or building.

The required prestress in the circumferentially placed rim and bracing members is generated by rigidly bolting or riveting or welding all the structural members using appropriate clamps and joints before removing the said tensioning devices and thus holding the radial members in the preloaded condition.

The adverse effects due to vibrational modes of the dish are minimized by means of obtaining sufficient stiffness by selecting dimensions of the radial structural members, rim structural members and bracing structural members of the intermediate circumferential rings including connection of a suitable number of such rings and/or using diagonally placed bracing members.

In order to minimize wind loads on the structural members, it is preferred to use tubes or pipes for the structural members which have low wind drag factor.

The reflector panels that are light in weight and also have low wind loading are fabricated by means of making prestressed frames using thin tubes or channels and then fixing welded wire mesh of appropriate mesh size and made of stainless steel wires of suitable diameter depending upon the highest frequency of operation of the preloaded parabolic dish.

Alternatively, the conventional reflector panels made of solid or perforated metal or metallized-plastic sheets are used.

Typically, a 12 m diameter preloaded parabolic dish is described, as an example, with preferred dimensions of the hub, radial members, rim members, bracing members, quadripod, inclination angle and location of the radial members and details of the reflecting surface.

BRIEF DESCRIPTION OF THE DRAWINGS

The invention will now be demonstrated in greater details with the help illustration contained in the accompanying drawings, in which specific and non-limiting embodiments of the invention are illustrated.

FIG. 1 shows back up structure of two parabolic dish antennas based on prior art;

FIG. 2 illustrates behaviour of an elastically bent structural member when it is connected to an Anchor after its preload is removed.

FIG. 11 is a diagram showing typical details of the rim joint 19 for connecting the radial structural members 6 to the rim members 7 of the outer peripheral/circumferential ring 12 shown in FIG. 3; two alternate arrangements are shown in FIGS. 11(*a*) and 11(*b*).

DETAILED DESCRIPTION OF THE INVENTION

FIG. 2(*a*) shows a single structural member 1 that is bent by a preload $P_s$. After the bending, the tip of the structural member is anchored to a stationary point 'S', with the help of another elastic member 2. At this point the preload is removed, which results in the relaxed shape of the structural member 3 but results in the tensile straining of the Anchor member 2. However, as the Anchor member is fairly rigid in the axial direction, there is no significant reduction in the preload and the combined system attains an internal elastic equilibrium (see FIG. 2(*b*). In the preloaded parabolic dish, the above anchoring is provided by the circumferential rim members which are considered fairly rigid in the axial direction of the tube and this is the actual configuration of the backup structure of the parabolic dish antenna under the zero wind condition.

It can now be seen that when the wind forces act from the front (concave) side of the dish, its shape will be maintained because the rim and bracing members which are fairly rigid, will take all the wind load and the radial members will act as simply supported beams with marginal distortion of their shape. In the event of wind coming from the back (convex) side, the dish will retain its original shape as long as the kinetic energy of the wind forces is less than the stored internal strain energy. In fact this is used to decide the amount of preload strain energy in order to ensure that this condition is always satisfied. However, in case wind forces do exceed the preload, the difference is supported by the rim and bracing members which can take significant amount of compressive load and prevents any significant distortion of the shape of the dish. Finally, it may be noted that while the primary intention of preload is to provide an initial strain energy, the process of bending the radial members results in a curve which is nearly a parabola. This gives the additional advantage of eliminating the process of separately forming the parabola and, thus, reduces the overall fabrication cost of the antenna.

Figure 1A:
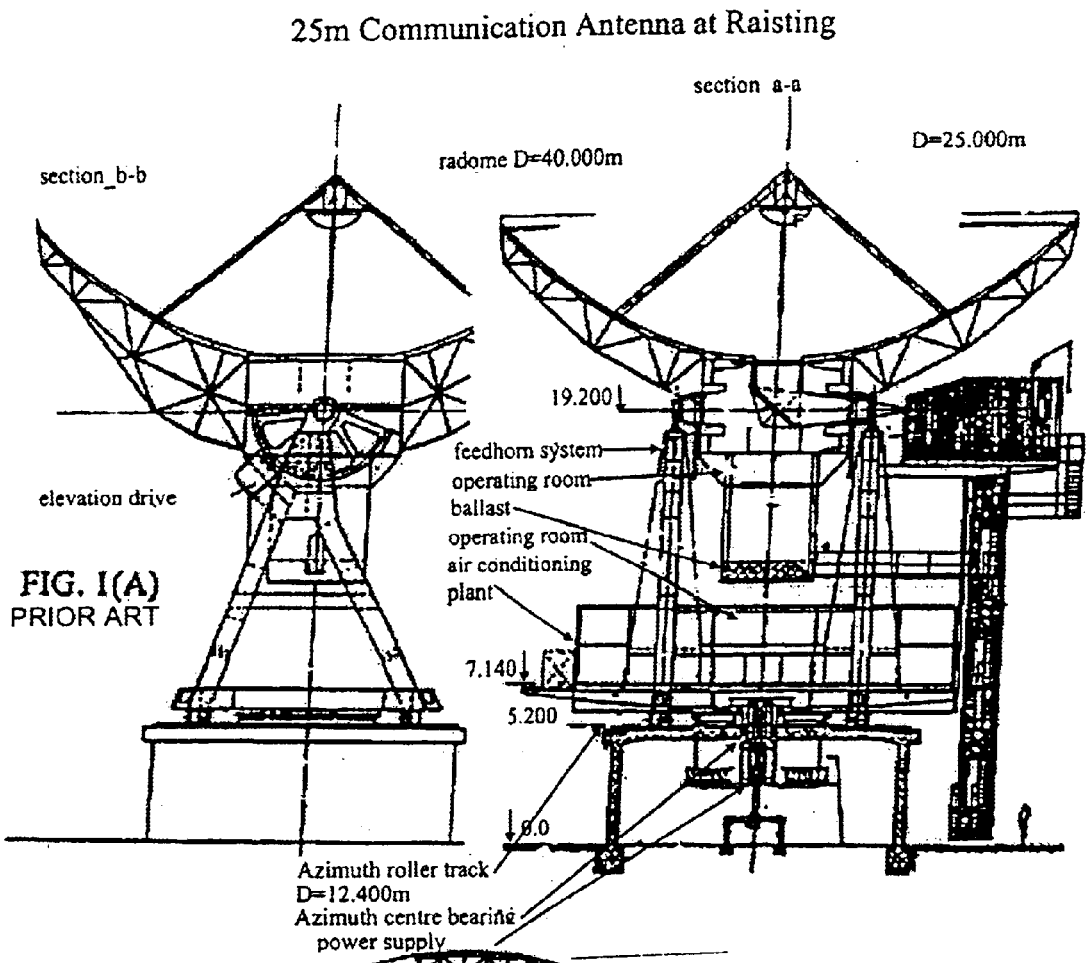
FIG. 1(A) PRIOR ART
FIG. 1(A) a 25-m antenna at Raisting (Ref. viii)
Figure 1B:
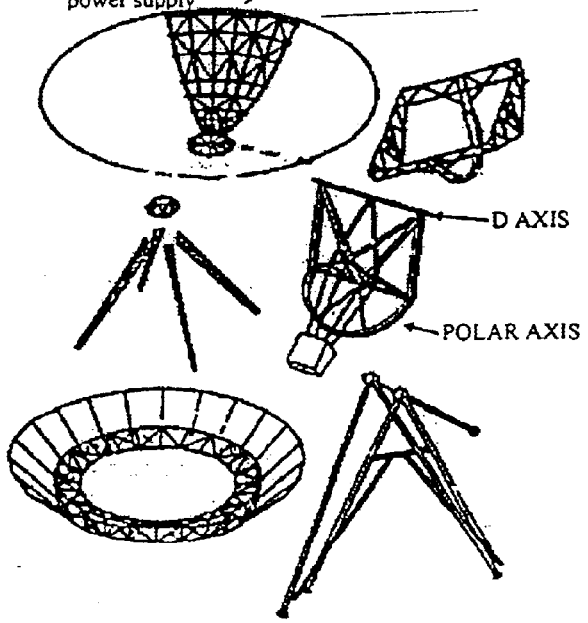
FIG. 1(B) PRIOR ART
FIG. 1(B) a 25-m antenna at Westerbork (Refs. i. and iv)
Figure 3:
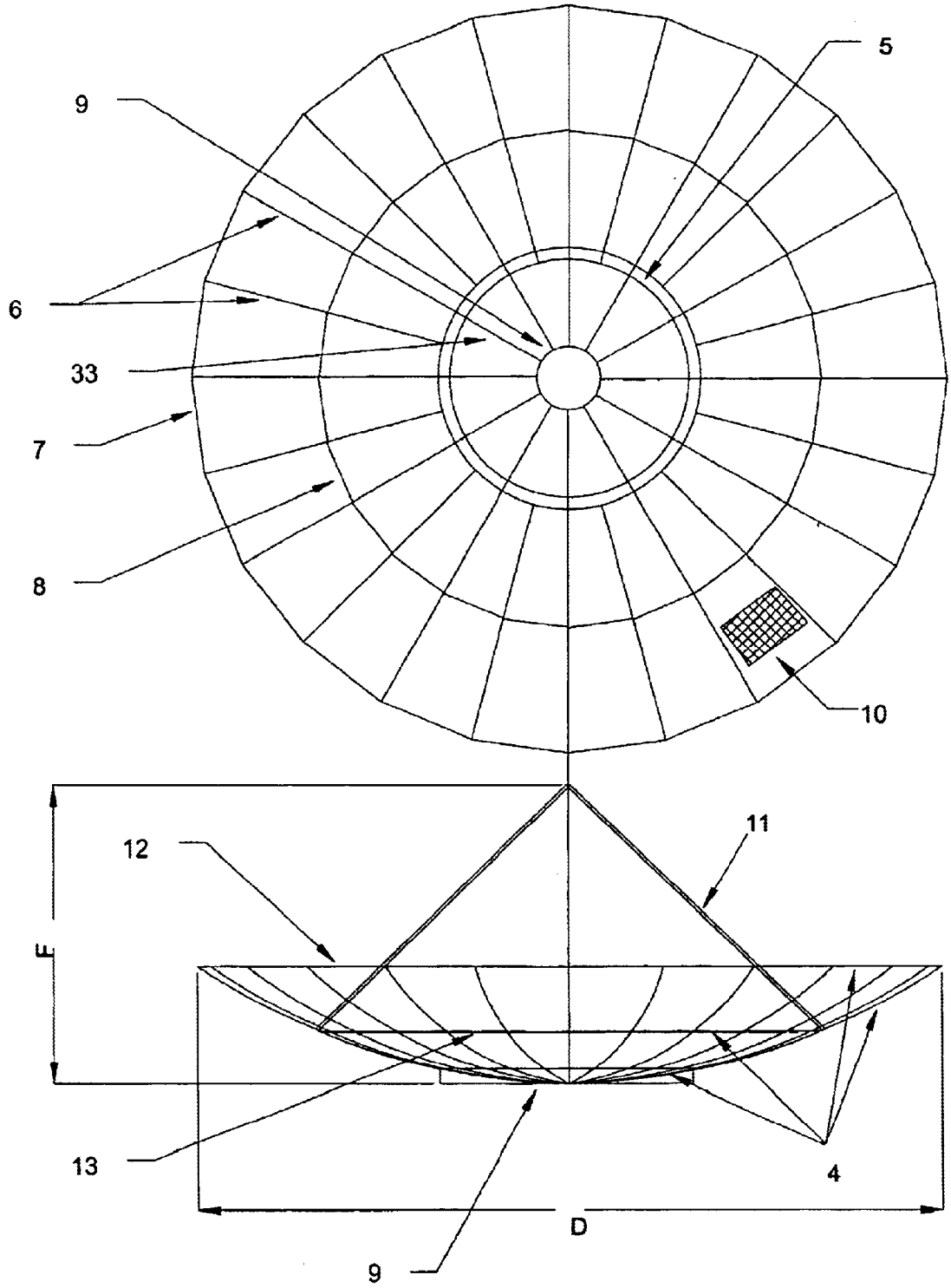
FIG. 3 is the plan and elevation of the back-up structure 4 of a preloaded parabolic dish demonstrating an embodiment of the present invention. The dish consists of a central hub 5, elastically bent radial members 6, interconnecting straight rim members 7, straight bracing members 8, quadripod 11, and reflecting surface 10. Number of the radial members 6 to be used depends on the diameter of the antenna. The preloaded parabolic dish antenna of 12 m diameter described in the Detailed Description of the Invention has 24 radial members 6.

In FIGS. 3 to 18 are shown details of a preloaded parabolic dish antenna having for example a 12 m circular diameter. The preloaded antenna consist of a hub 5, curved radial members 6, straight rim members 7 of the outer circumferential ring 12, straight bracing members 8 of the intermediate circumferential ring 13, a quadripod 11, inner ring 9 and reflector panels 10. The radial members 6, rim members 7 and bracing members 8 are joined together rigidly using clamps, joints and other gadgets shown in FIGS. 6 to 13. Inside the hub 5 the antenna has inner curved radial members 33 (FIG. 6) connected to a ring at the centre 9 (FIG. 3).

The back-up structure 4 of a parabolic dish incorporates a hub 5 for the purpose of its connection to a drive system mounted on a yoke and a tower for supporting the dish. In practice, the diameter of the hub 5 varies from about ¼ to ½ of the diameter of the dish. In the present example, the hub 5 has a diameter of ⅓rd of the dish diameter. The design of the inner parabolic dish between its apex and hub 5 is relatively straight forward and is based on conventional practice.

Figure 5:
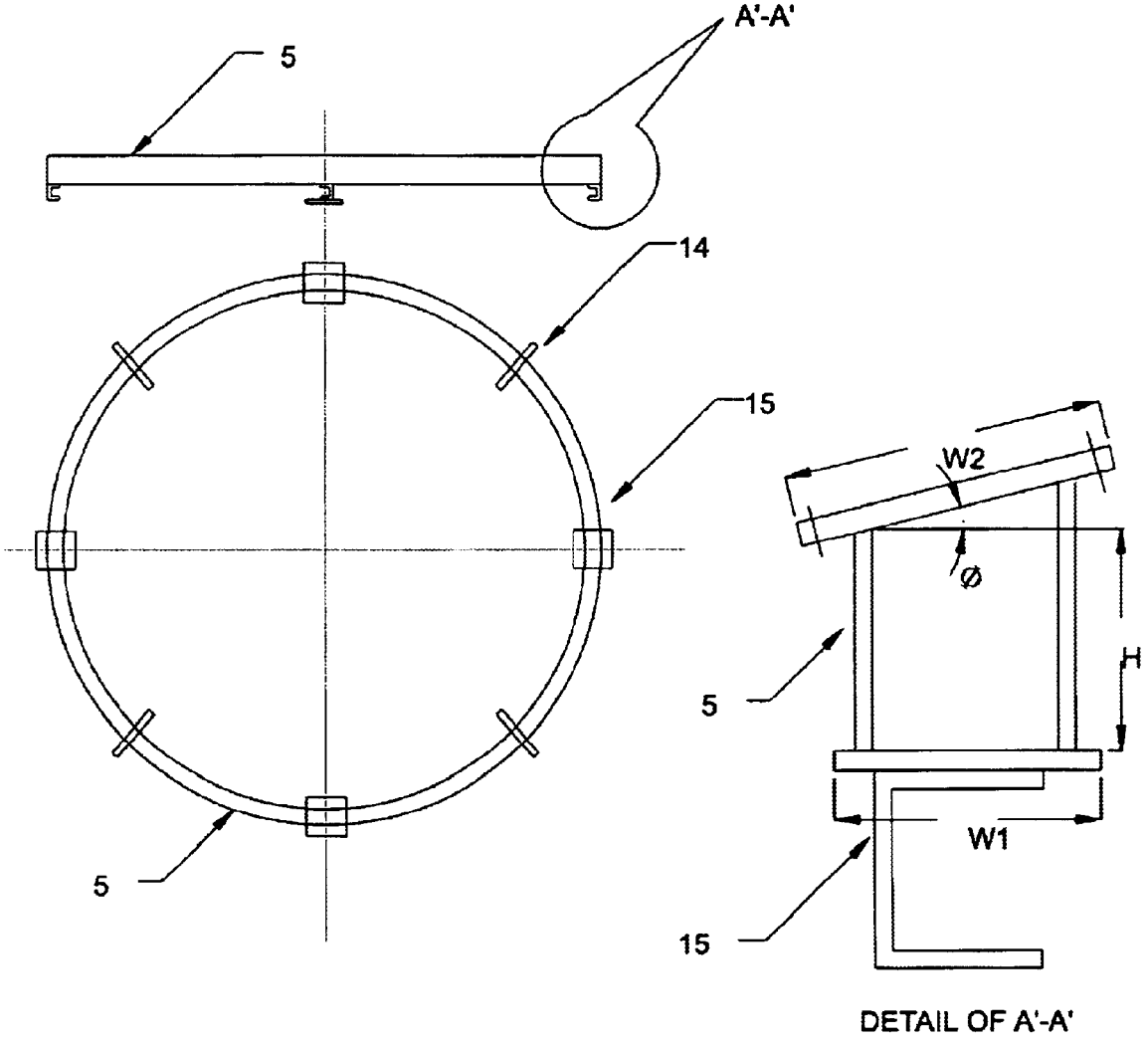
FIG. 5 shows plan elevation and cross-section of the hub 5.
Figure 6:
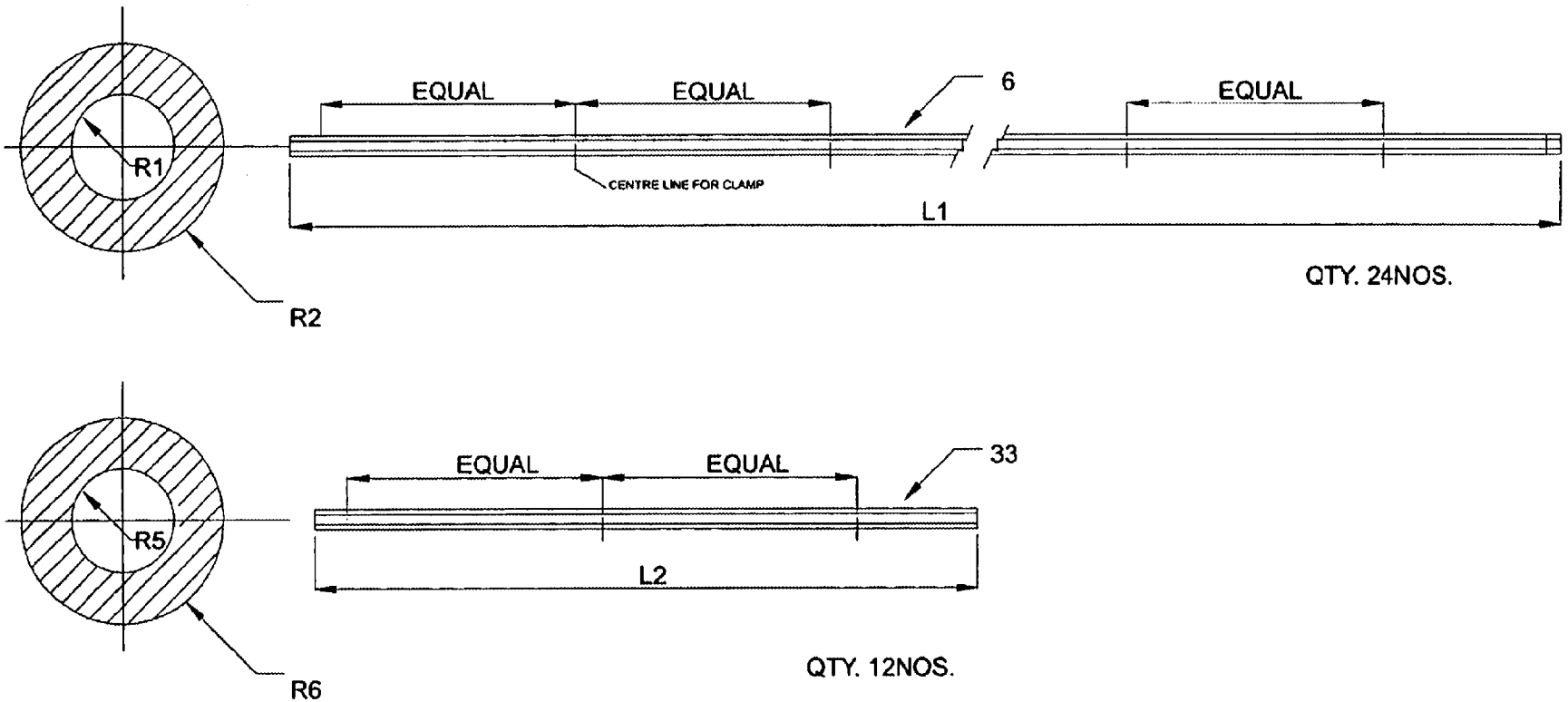
FIG. 6 gives typical details of the radial tubular members 6 which are outside the hub and those which are inside the hub 33.
Figure 7:
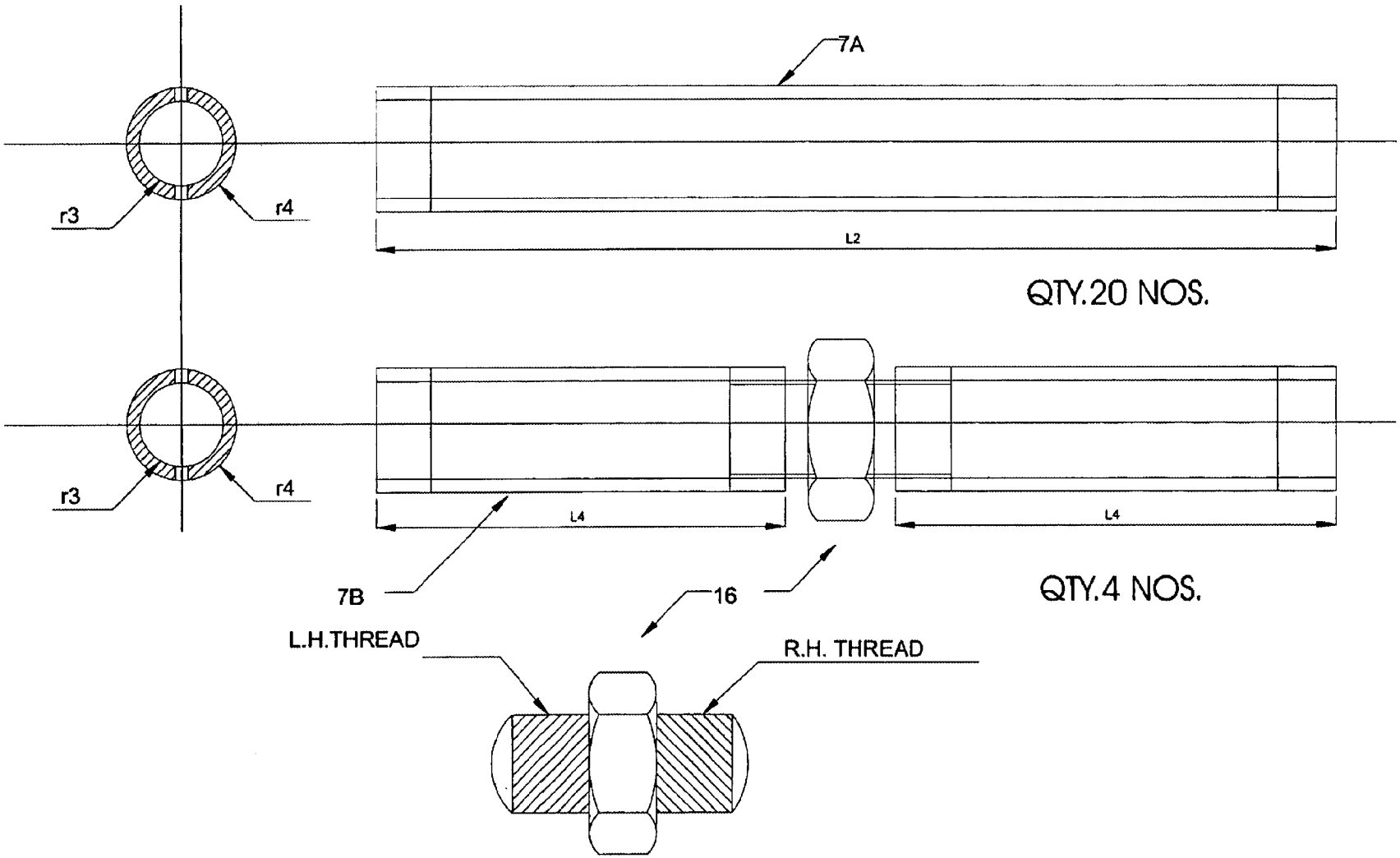
FIG. 7 gives typical details of the rim members 7 of the peripheral ring 12 (rim). For the 12 m dish antenna, every 6th rim member called 7B is provided with length adjustment bolt 16; other rim members are shown as 7A.
Figure 8:
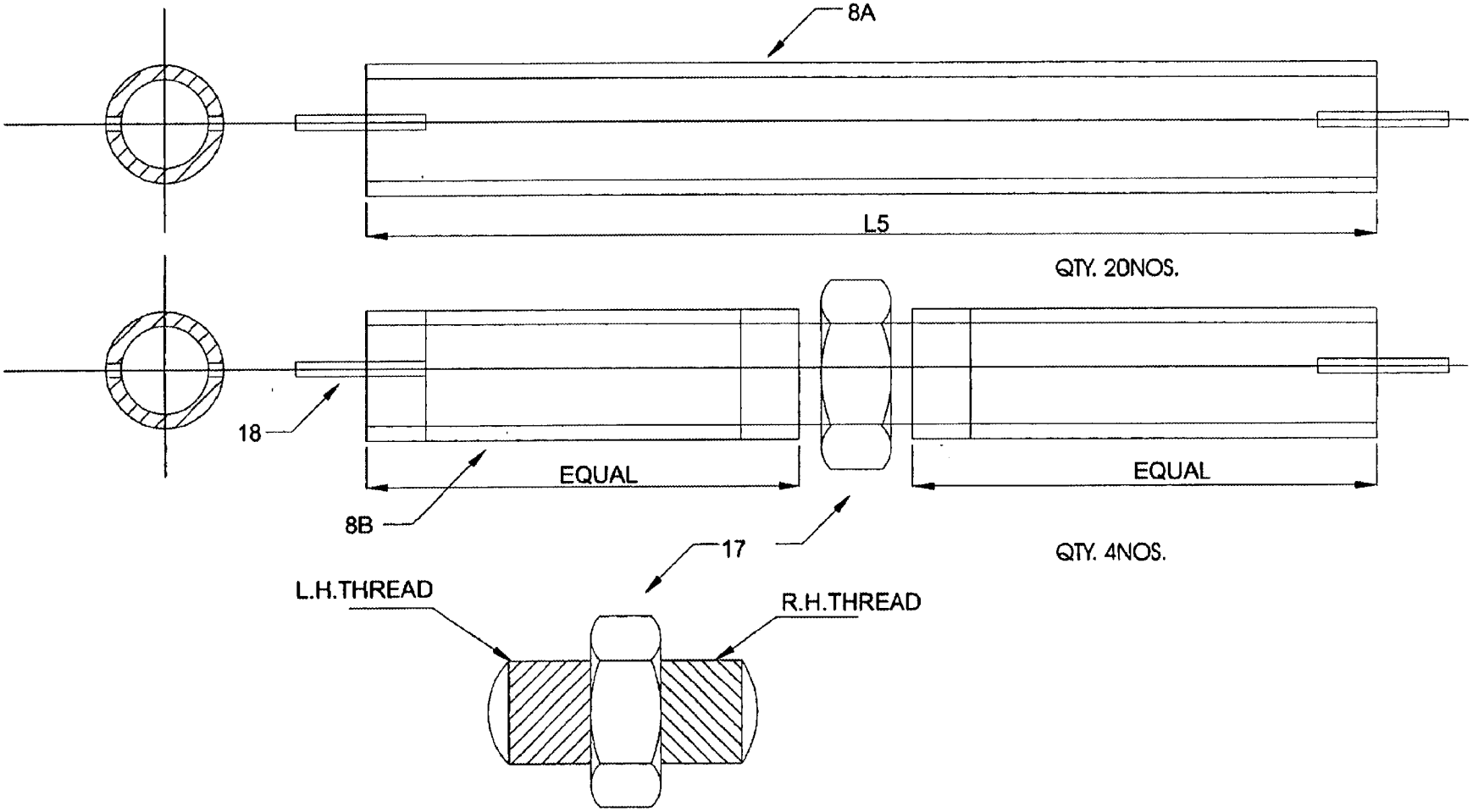
FIG. 8 gives typical details of the structural members of the bracing members 8 for the intermediate circumferential ring 13. For the 12 m dish antenna, every $6^{th}$ bracing member called 8B is provided a length adjustment bolt 17; other bracing members are shown as 8A.
Figure 9:
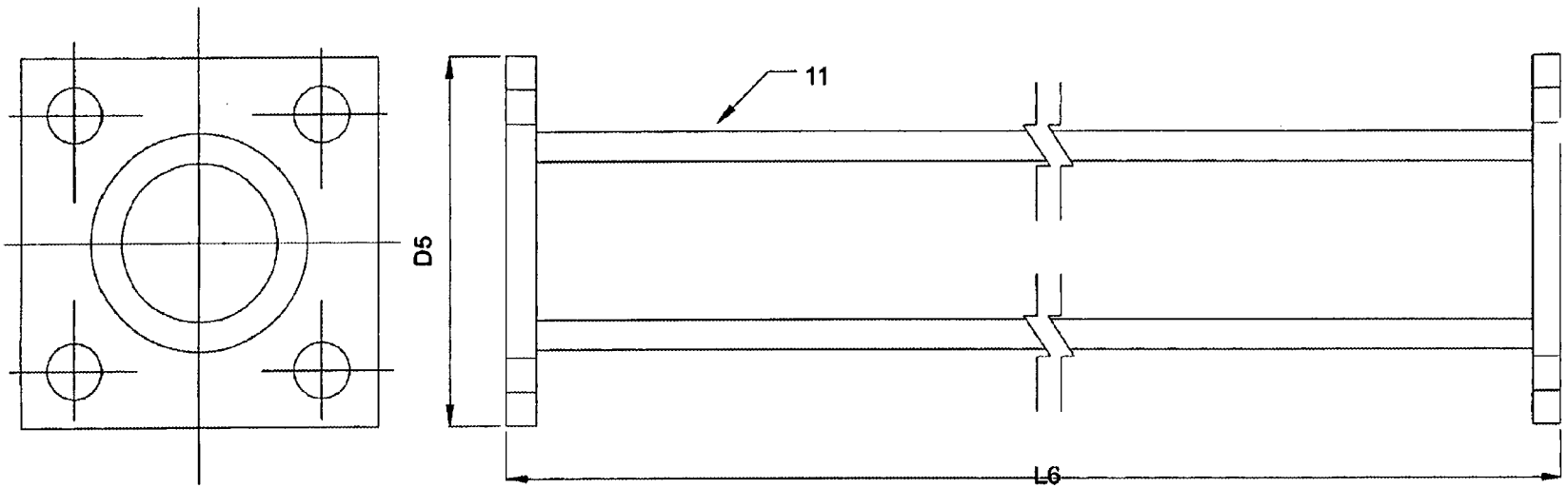
FIG. 9 gives typical details of the quadripod tubes 11.
Figure 10:
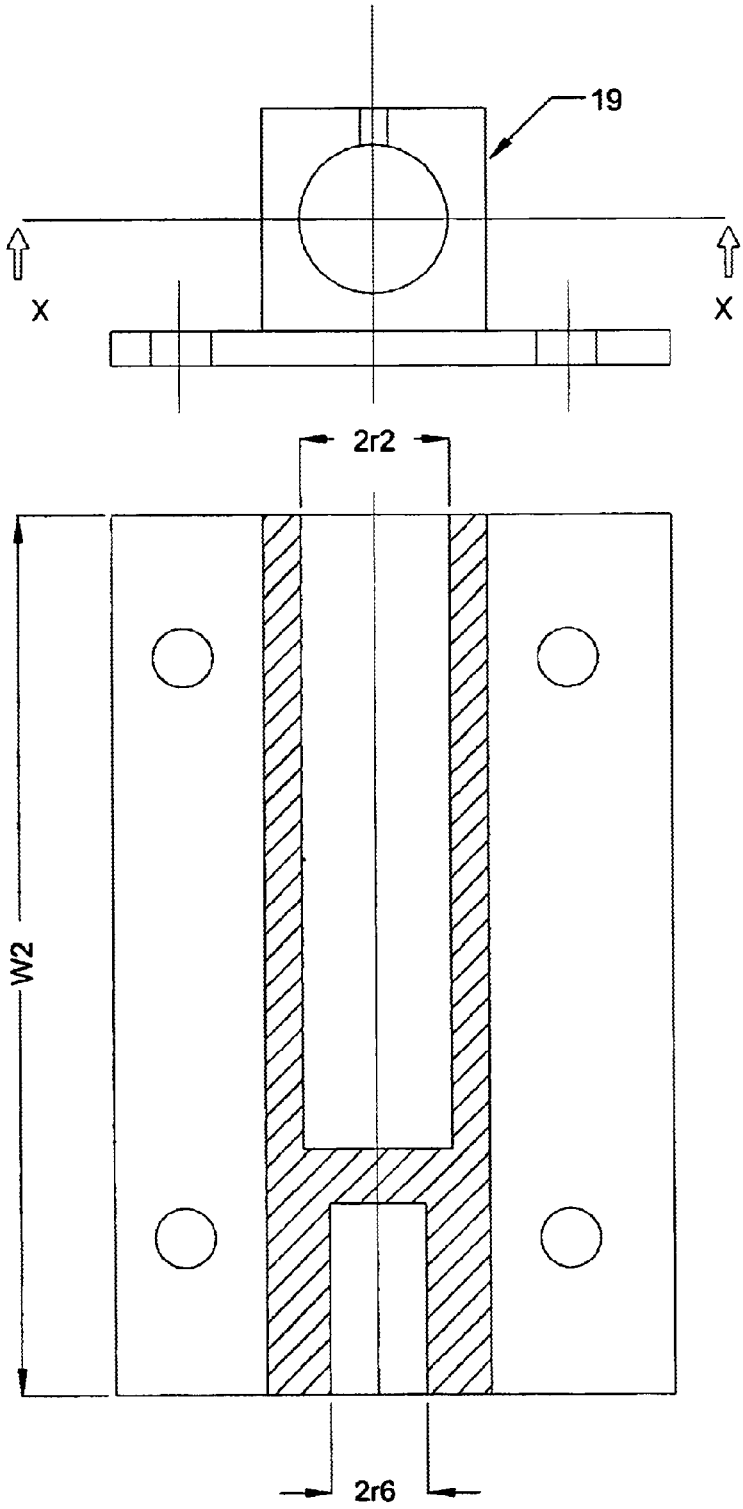
FIG. 10 gives typical details of the hub mounting pad 34 for clamping the radial members (tubes) at a required inclination angle at the hub 5 with respect to the x axis of the parabola. Dimensions shown are for the case of the 12 m dish antenna.

In the present example of a 12 m parabolic dish, four quadrants of the hub 5 are first assembled by clamping four plates 14 using 18 mm tight fit bolts and the hub 5 is then mounted on four temporary pillars by clamping on four legs 15 of the hub (FIG. 5). It may be noted that the hub is made out of welded mild-steel plates, machined and cut into 4 pieces for easy transport but it could also be transported as a single unit.

Next, 24 nos. of hub mounting-pads 19 (FIG. 10) are bolted at equal circumferential distances on the hub 5. All the 24 nos. of radial members 6 are then connected rigidly to the mounting-pads 19. Using a theodolite placed at the centre of the parabolic dish, it is ensured that the tips of all the 24 nos. of radial members 6 lie at equal angular distances and are in one horizontal plane. The radial members 6 are then bent elastically by applying a force with a normal component at their tips using steel ropes 28 and turnbuckles 25 attached to a ring-plate 24 supported on a vertical tower 27 connected on the hub 5 (see FIGS. 17 & 18) which is erected temporarily to lie along the central axis of the 12-m parabolic dish. Each of the radial members 6 is bent elastically to a specified height from the 'x' axis of the parabola in the 'y' direction, (FIG. 4) using a theodolite placed at the centre of the dish and thus the radial members get prestressed or preloaded to a calculated value.

Figure 12:
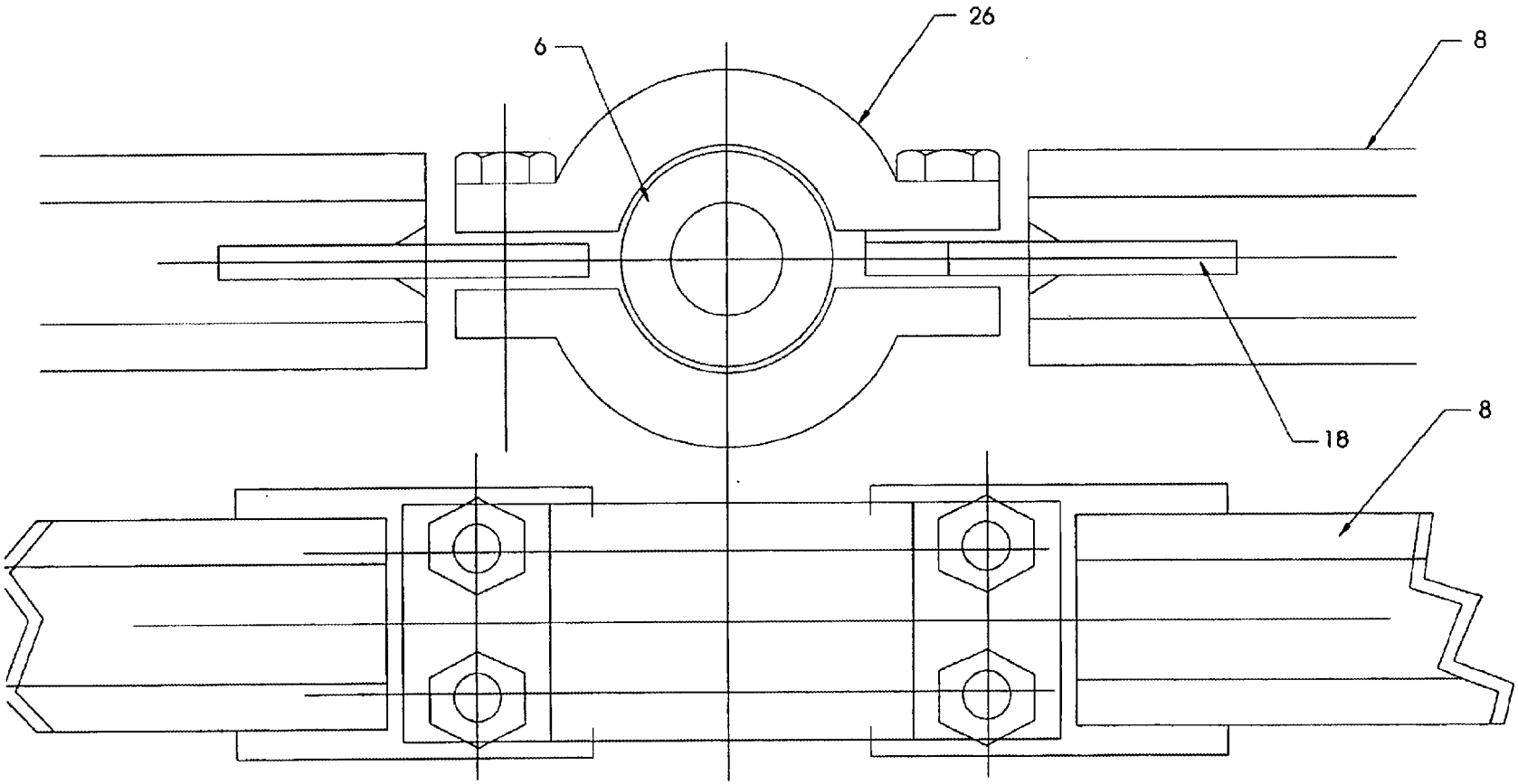
FIG. 12 shows typical details of the bracing joint 18 & 26 for connecting the radial structural members 6 to the bracing members 8 of the intermediate circumferential ring 13 shown in FIG. 3.
Figure 13:
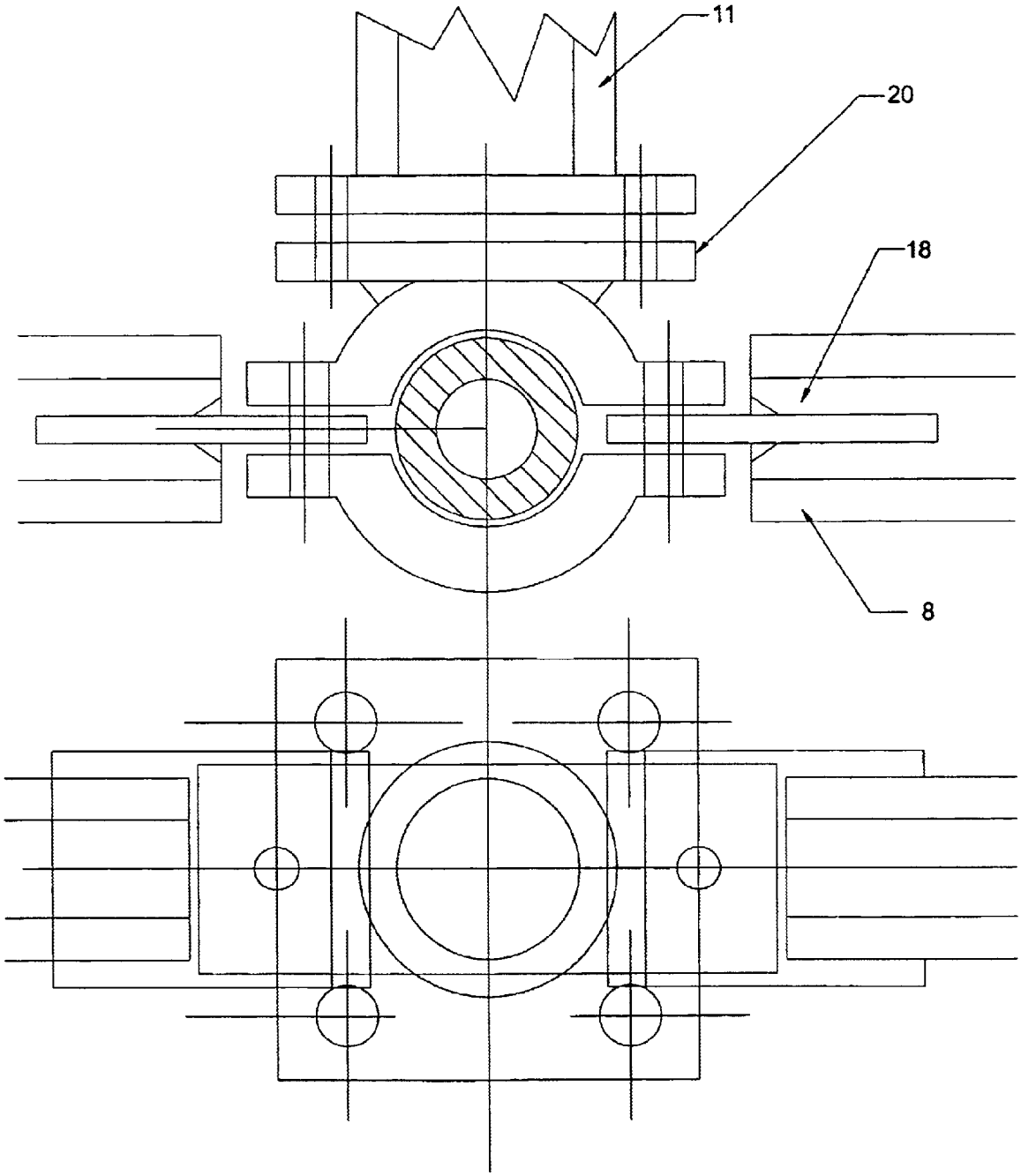
FIG. 13 shows details of quadripod joint 20 for connecting the four legs of the quadripod 11 to the bracing members 8.

Radial members 6 are then interconnected to straight bracing members 8 of the intermediate circumferential ring 13 using bracing joints 18 and 26 (FIG. 12). Adjustment bolts 17 of the bracing members (FIG. 8) are adjusted, if required to ensure that the intermediate ring 13 is rigidly connected to the radial members 6. Next, the tips of the radial members 6 are rigidly connected to the rim members 7 using the rim joints 19A or 19B (FIG. 11) at the periphery of the dish. Next, the steel ropes 28 and turn buckles 25 are loosened and adjustments made using the adjustment-bolts 16 (FIG. 7) to ensure that the circumferentially placed rim members 7 get rigidly connected to the radial members. Next the central tensioning tower 27 is removed and the quadripod 11 (FIG. 9) is mounted on the radial members 6 at the location of the bracing members 8 of the intermediate ring 13 using the quadripod flange 20 (FIGS. 3 & 13). Next panel-mounting gadgets 29, 30, 31, 32 (FIG. 16) for mounting the reflector panels 10 (FIGS. 14 & 15), are attached to the radial members 6. The length L of the adjustable bolts 31 (FIG. 16) is adjusted using a centrally placed theodolite to ensure that the heights of the mounting plates 32 for bolting the reflector panels lie along the desired parabolic curve within a tolerance of ±0.5 mm. The reflector panels are then mounted on mounting plates and surface accuracy is then measured using the theodolite. Suitable adjustments are made in order to ensure that the reflecting surface lies within specified tolerances.

It may be noted that the rim members connected at the peripheral of the dish and bracing members along the inner circumferential rings form a polygon as all these members are straight structural members.

For the said 12 m diameter parabolic dish described in this embodiment, a wire mesh was selected for the reflecting surface for minimizing the wind loads, which results in considerable economy. The wire mesh has a size of 6 mm×6 mm and consists of stainless steel wire of 0.55 mm diameter which allows operation of the dish up to about 8 GHz. Finer wire mesh or perforated metal sheets or metallic plates may be used for operation at higher frequencies. One may use panels made of metal sheets or a pressed parabolic dish for the central part of the dish and wire mesh for the outer part in order to reduce wind loads yet allow operation up to about 22 GHz.

On selection of the geometry of the parabolic dish and calculating the wind forces on the reflector surface and back-up structure, it becomes possible to determine the value of the required inclination angle of the radial members 6 at the hub 5 and the force to be applied at the tip of the radial members 6 for the required preload. For appropriate dimensions and strength of the materials of the radial members 6, we use initially elementary beam theory as given by $d=P_tL_s^3/(3\ E_sI_s)$, where d is the elastic tip deformation, $P_t$ is the tip pre-load in the normal direction, $L_s$ is the length of the radial member 6, $E_s$ is the modules of elasticity of the material of the radial member 6 and $I_s$ is the moment of inertia of the radial member 6. This relation can be used for both straight as well as moderately curved radial members 6, with sufficient accuracy.

Figure 4:
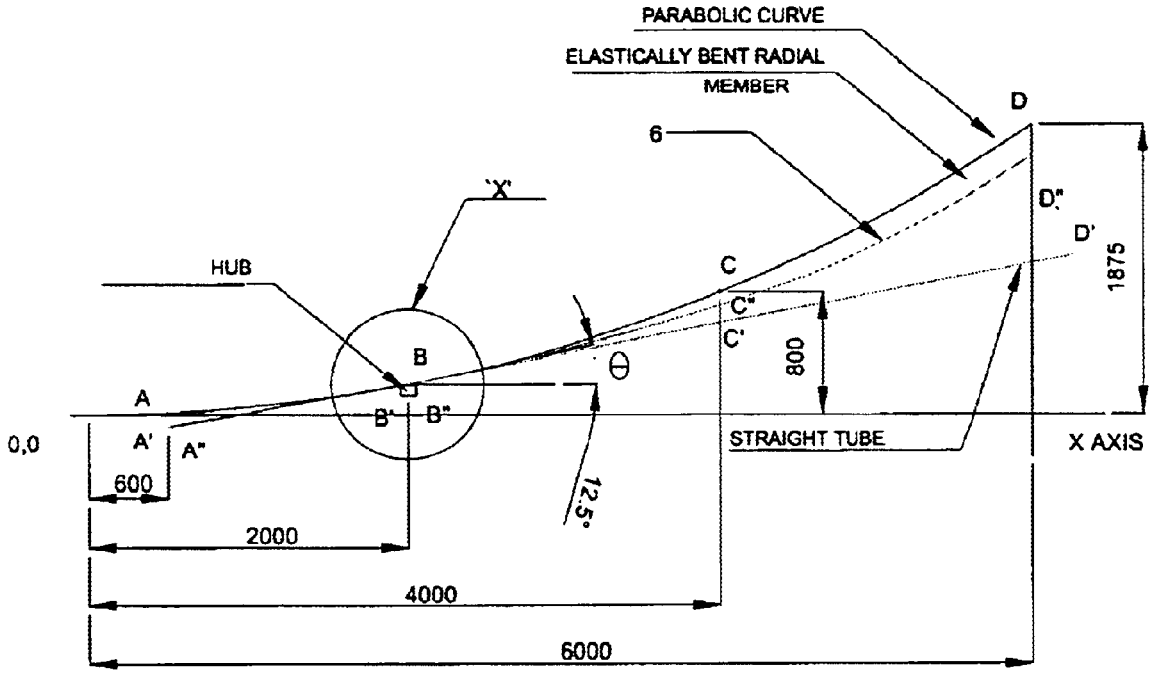
FIG. 4 is a schematic in which the dotted line (A', B', C', D') shows position and orientation of one of the straight radial structural members (tube) 6 of FIG. 3 before it is bent and the broken line shows its orientation after it is elastically bent. The full line curve shows the true parabolic curve. The dimensions given in FIG. 4 are for the specific case of a 12 m dia. preloaded parabolic dish antenna
Figure 4:
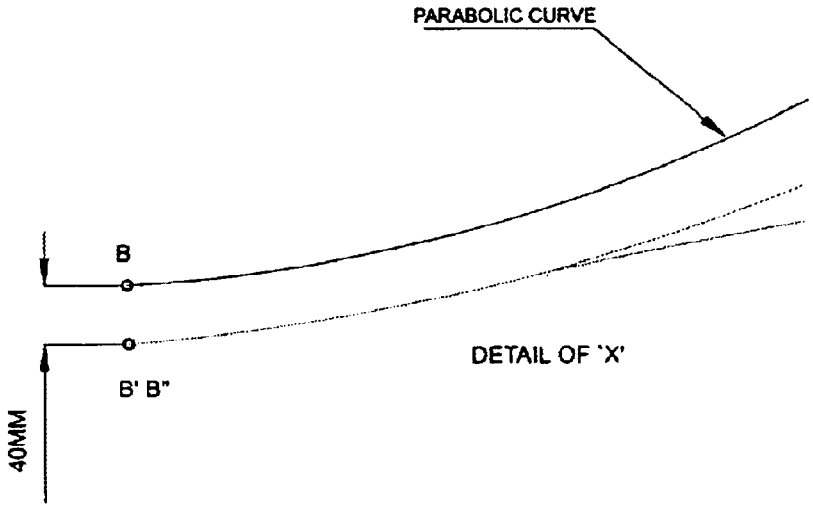

In case the radial members 6 are pre-curved to a small extent for a closer confirmation to the parabolic curve, it is possible to define the required elastic deformation, $d_e$, of the tip of the radial member 6 which has a finite curvature, as, $$d_e=(Y_h-Y_t)/\cos\theta_h-\{R-\sqrt{[R^2-(x_t^2-x_h^2)]}\}$$

where, $Y_h$ is the y-coordinate at the hub 5, $Y_t$ is the y-coordinate at tip, $X_h$ is the x-coordinate at the hub 5, $x_t$ is the x-coordinate at tip, R is the radius of the pre-curved radial member 6 and $\theta_h$ is the setting angle of the radial member 6 at the hub 5 (FIG. 4).

It may be mentioned that the initial setting angle, $\theta_h$, of the radial members 6 at the hub 5 is an important parameter that affects (1) the magnitude of the preload and (2) the deviation between the shape of the bent radial members 6 and the exact parabola. Further, it is to be mentioned here that if preloading of the radial members 6 is to be reduced, pre-curved radial members 6 can be used which reduce the extent of the elastic deformation and the preload or prestress. However, then the advantage of the stored internal strain energy is lost to some extent and it is necessary to understand the trade-off between these two for deciding to use the straight or the pre-curved radial members 6. Finally, the design of the radial member 6 is subject to the condition that the deformed shape must always lie below the exact parabola because the deviations then can be exactly covered using adjustable bolts 31, leading to a fairly close match of the reflector surface with the exact paraboloidal surface. A detailed finite element stress analysis of the entire back-up structure 4 including the radial members 6 under the maximum load conditions, corresponding to the dish facing horizon and the maximum wind coming from the front and the back, has been carried out for the 12 m dish and it was decided to use high tensile (60 kg/mm$^2$) radial tubular members of 40 mm diameter and 8 mm wall thickness. Alternatively tubes of 45 mm diameter and 6 mm wall thickness can be used. In the analysis carried out, both the wind load and the dead load are added in a scalar sense and it is seen that the effective stress due to wind loads is of the order of 73% of the allowable stress at the survival wind speeds. The allowable stress is taken as 85% of the yield strength. It may be recalled here that the prestress is of the order of 95% of the allowable stress which indicates that the maximum wind kinetic energy at 150 kmph is only about 75% of the stored internal strain energy of the radial members in the form of prestress. Thus, there is about 20% margin for the stress before rim members 7 go slack and go in compression. There is no significant increase in the stress of the radial members 6 because they are effectively anchored in the rim members 7 and bracing members 8.

The circumferentially located straight rim members 7 have the important function of connecting the adjacent tips of all the 24 parabolic radial members 6. These rim members 7 also prevent the springback of the pre-stressed radial members, besides providing the hoop mode strength to the dish structure. However, as the radial member 6 is a large member, it can bend significantly between its two end points (i.e. one end at the tip and the other end at the hub), in addition to the requirement of quadripod being supported on the radial member 6 which can cause additional deformations. All these have the potential to increase the dish distortion to unacceptable levels under the operational conditions and in order to reduce this distortion, the intermediate bracing members 8 are provided for the 12 m dish (FIG. 3).

The intermediate bracing members 8 together with the hub 5 and the rim members 7, divide the total outer dish into radially two equal parts. It is seen that when the radial members try to bend inwards (dish overall closing mode), the rim members 7 and bracing members 8 go into compression and when the radial members 6 try to bend outward (dish overall opening mode), these members go into tension so that the overall dish distortion is minimized. It may be mentioned here that these rim members 7 and bracing members 8 do not play any role in the dish overall pure twisting mode as they undergo in-plane rigid body rotation in this mode of elastic deformation and in this case only the radial members 6 provide the total twisting stiffness to the dish. For the 12 m dish although the rim members 7 and the bracing members 8 are subjected to smaller loads than that of the radial members 6, but the tube diameter of 40 mm and wall thickness of 8 mm is chosen for these members also. This is also considered adequate for the purpose of resisting compressive loads in the dish closing mode.

Figure 14:
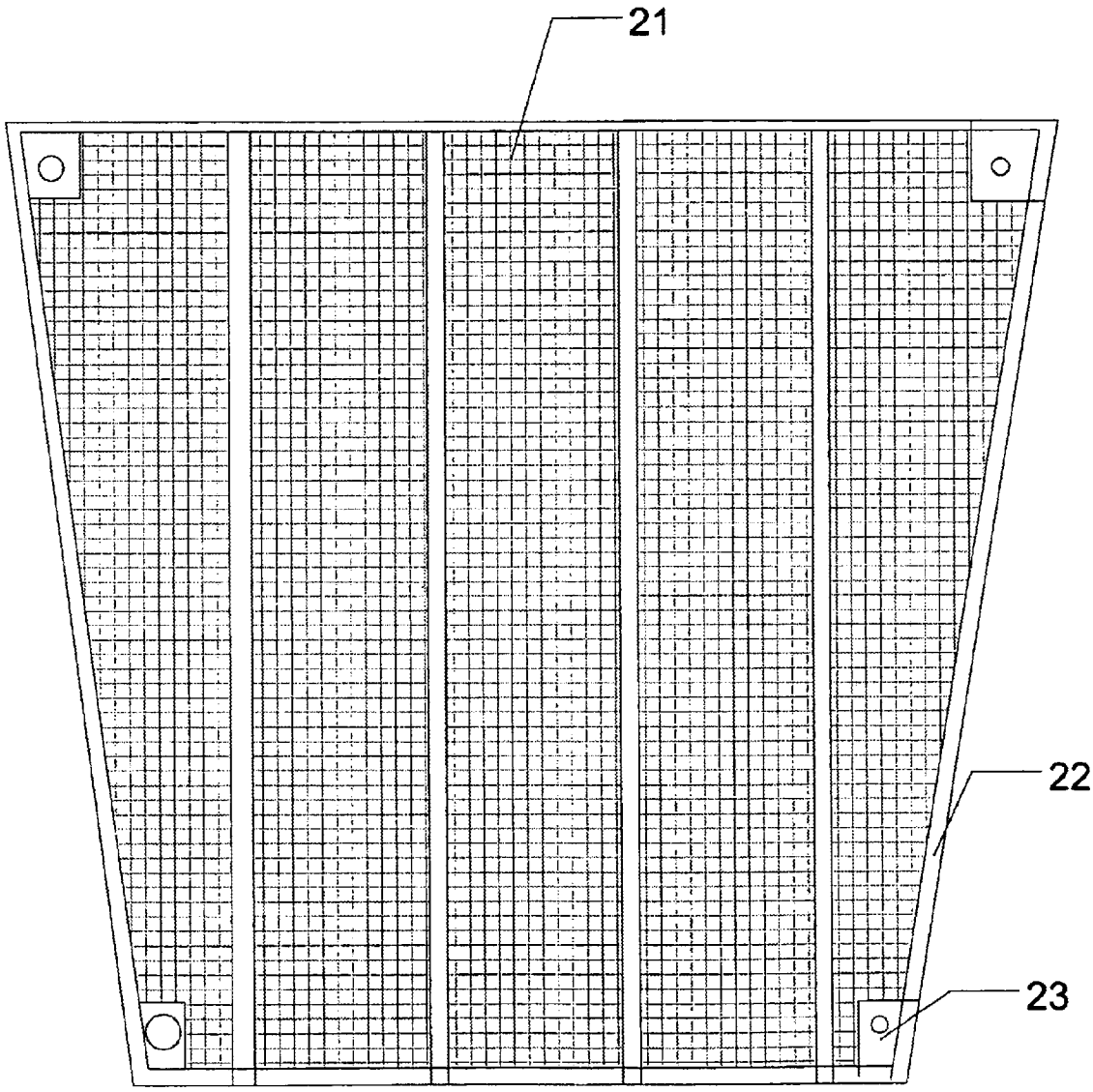
FIG. 14 is a diagram giving details of one of the reflector panels 10 consisting of wire mesh 21, frame 22 and mounting plates 23 of the 12 m preloaded parabolic dish.

It was mentioned earlier that the difference in the shape of the elastically bent radial member 6 and the exact parabolic curve can be compensated suitably by using adjustable bolts 31 and is, therefore, not a cause for concern in the design of the preloaded parabolic dish and is also not treated as an error, but only as a deviation which is to be adjusted. The parabolic reflector surface is required to be assembled from the wire mesh panels 10 which are made of stainless steel wire mesh 21 tack welded by resistive arc welding to a metallic frame 22 attached to mounting plates 23. These panels 10 are fairly big in size and could be made flat in both radial as well as circumferential direction leading to a facet approximation of the exact paraboloidal surface in case the metallic frame 22 is made of straight structural members (FIG. 14). The inaccuracies of the reflector surface can be reduced by increasing the number of panels 10 in radial direction as well as reducing the size of the panel 10 in the circumferential direction. It should be re-iterated here that the size of mesh panel 10 in circumferential direction is decided by the number of radial members 6 which is fixed initially and therefore the only other option open is to increase the number of panels in the radial direction. By using 8 nos. of mesh panels 10 in the radial direction for the 12 m dish, it is found that the peak error is of the order of 3.5 mm and the root mean square (rms) error is of the order of 2.4 mm. In this case the size of the largest mesh panel is 1567 mm×544 mm near the tip of the dish and the smallest mesh panel is of the size 574 mm×900 mm near the hub of the dish.

With regard to the errors in the circumferential direction, it is well known that a flat wire mesh panel, sags like a catenary surface describing another parabola, under its own weight. In addition, it is seen that, to correctly represent the paraboloidal surface in the circumferential direction, it is necessary to have a specific sag at a specific radial location. Also, the wire mesh needs to be kept in a fairly stretched condition to avoid surface wrinkles as well as the reverse sag when the dish is at 45°, requiring a large pretension in the wire mesh which renders it practically flat in the circumferential direction. All these effects make the creation of a near paraboloidal surface in the circumferential direction, a complex task and the problem of a required sag from a practically flat mesh panel can be overcome to some extent, by pulling the wire mesh down with the help of two thin cables connected at points symmetrical about the mesh panel centerline. This has the dual advantage of providing the required sag in the presence of large in-plane tension in the mesh, while simultaneously increasing the in-plane tension of the mesh due to non-linear stretching associated with the downward pulling. This helps further to make the wire mesh free from wrinkles and to retain its shape even when the dish faces horizon.

Figure 15:
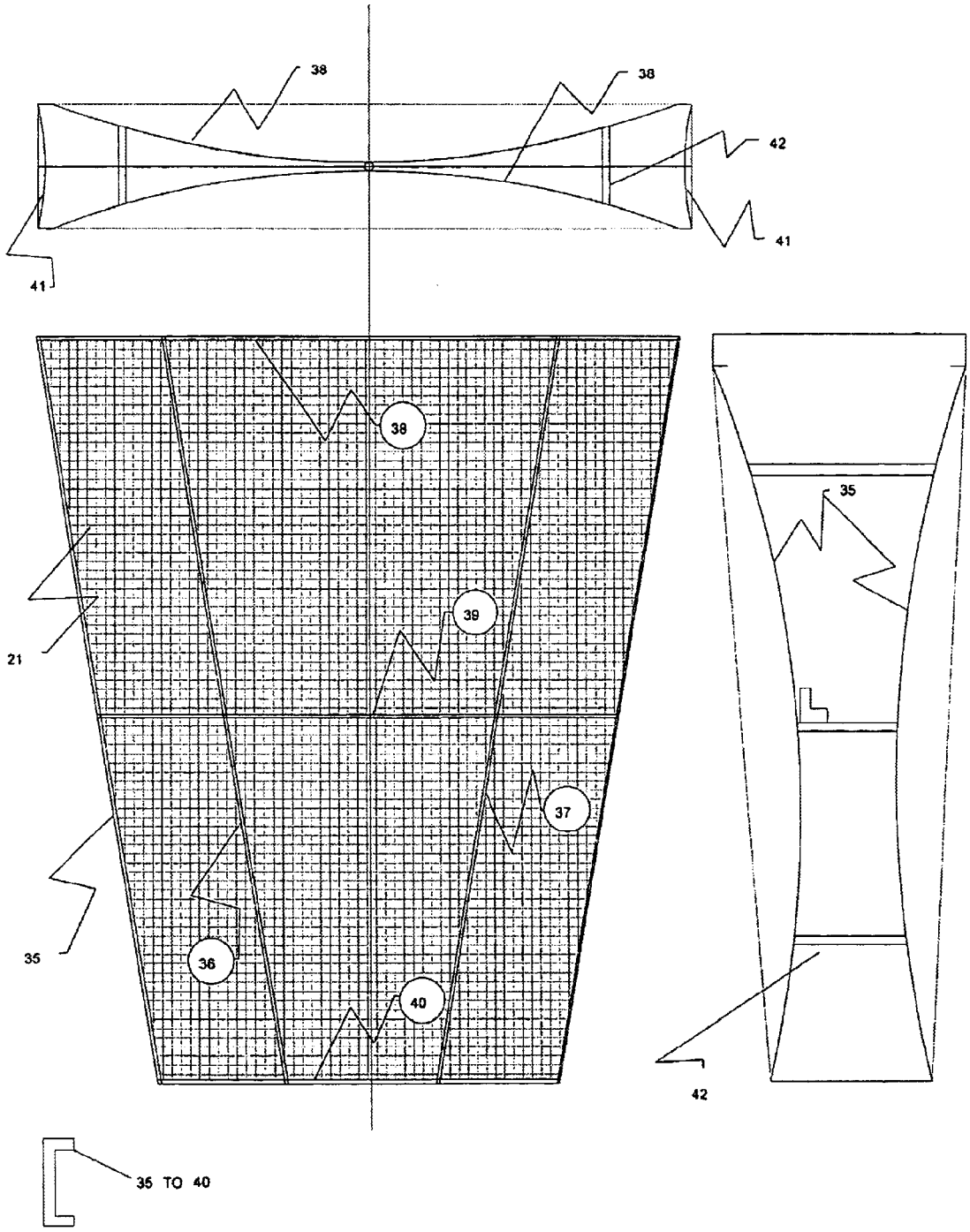
FIG. 15 shows details of a rigid panel of light weight consisting of stretched wire-mesh 21 attached to a rigid frame which is tensioned, using thin structural members 35, 36, 37, 38, 39, 40, 41 that are connected back to back using spacers 42.

In FIG. 15 are shown a reflecting panel 10 in which the steel members 35 to 41 of the frame supporting the wire mesh are provided curvature, for reducing the rms error of the reflecting surface, by first welding or bolting or riveting thin channels or tubes made of stainless steel in a rectangular form as shown by dotted lines in FIG. 15. These are then prestressed using rivets and spacers 42 as shown in FIG. 15 and then assembled together to provide a reflector panel 10 consisting of stretched mesh 21 attached to rigid trusses (nicknamed as SMART design).

Figure 16:
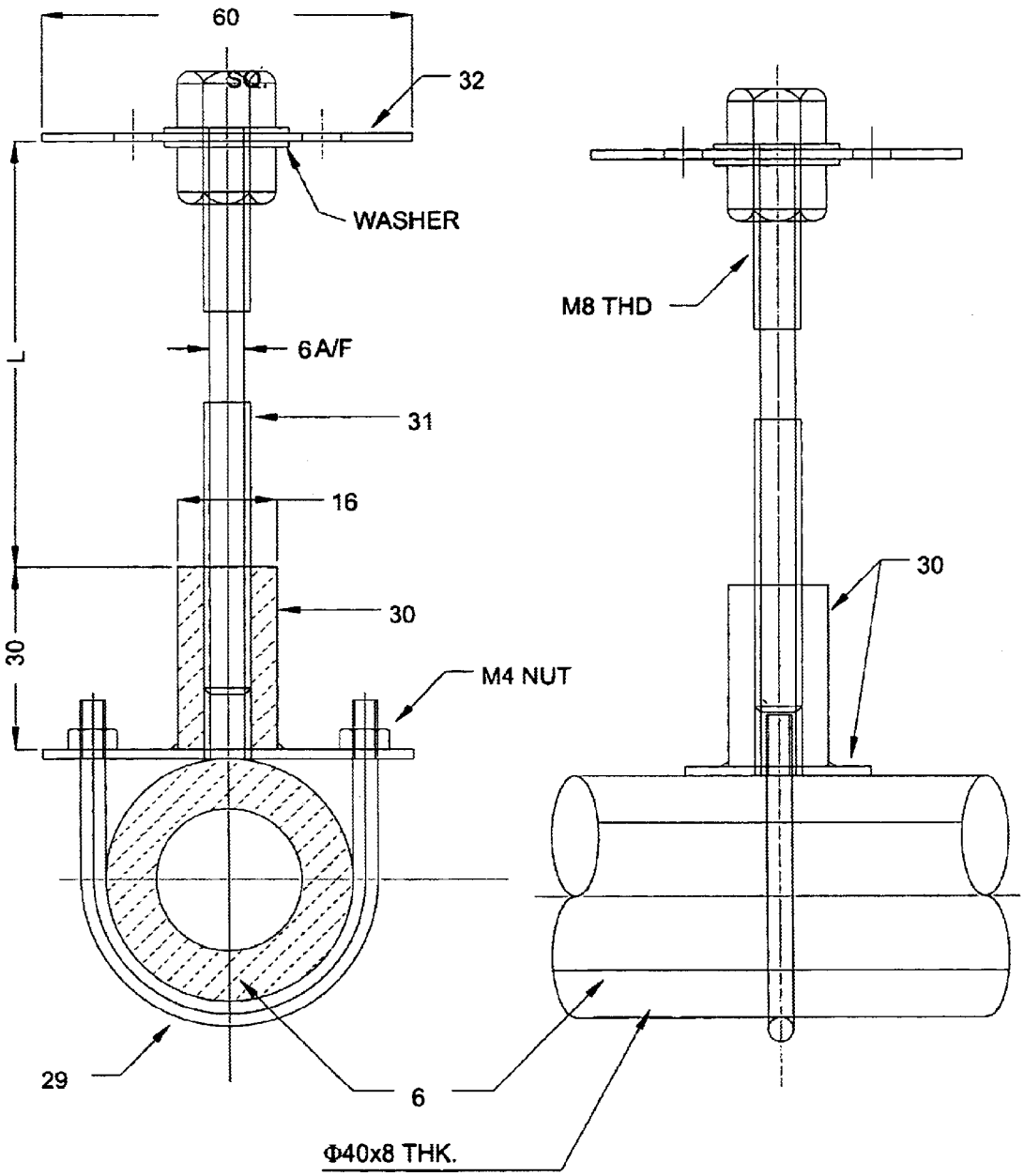
FIG. 16 shows typical details of the mounting gadgets 29, 30, 32 for connecting the reflector panels of the 12-m dish antenna to the radial members using adjustable bolts 31.
Figure 17:
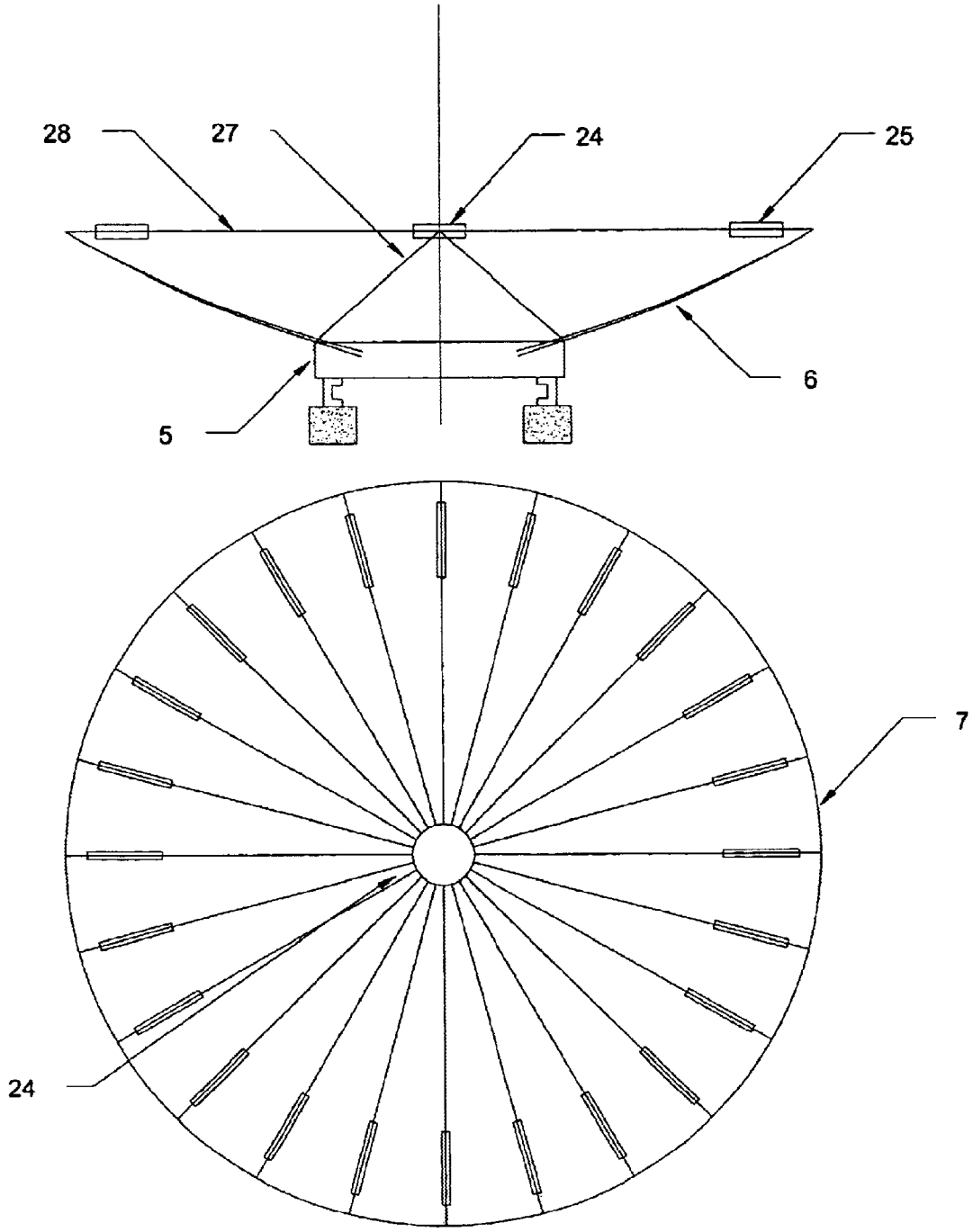
FIG. 17 shows schematic of the tensioning unit 26 consisting of a temporarily erected tower 27, steel ropes 21 and turnbuckles 25 for preloading (prestressing) the radial members 7.
Figure 18:
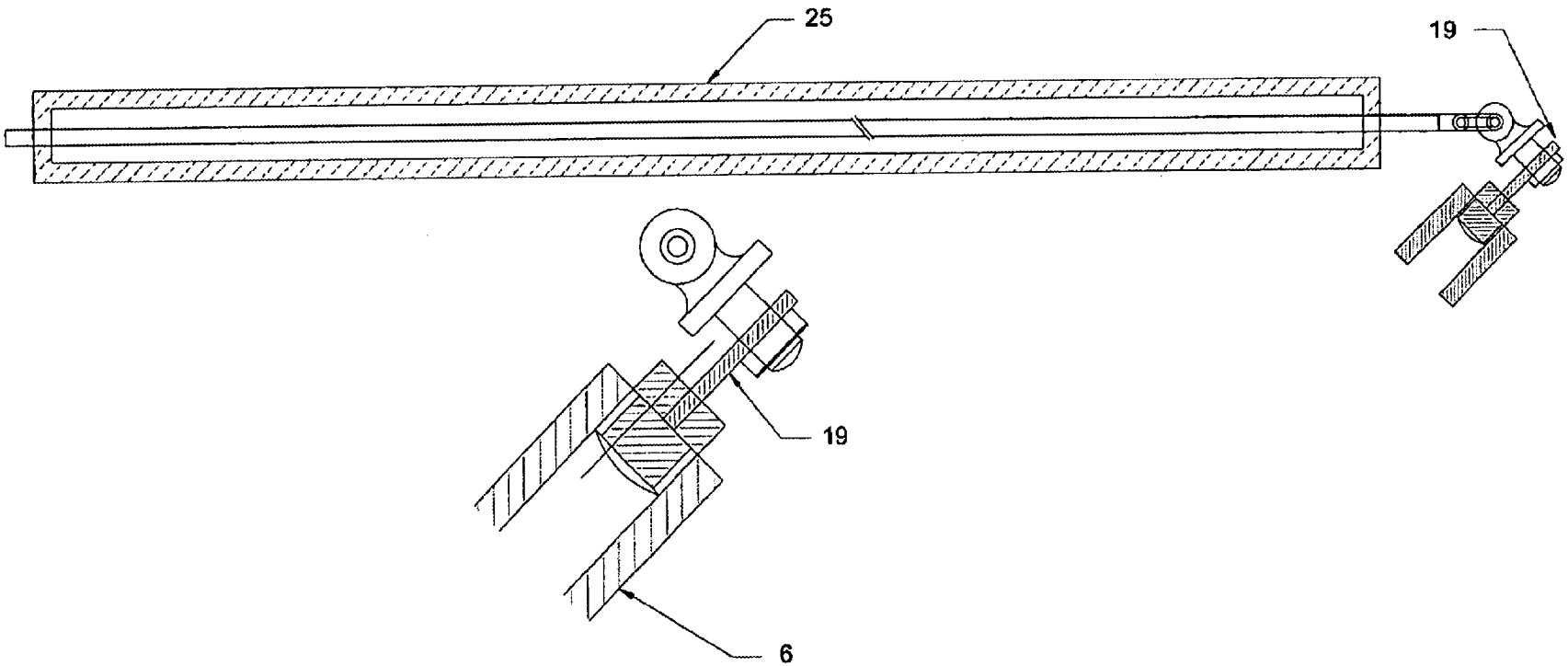
FIG. 18 shows details of the turnbuckle 25 attached to the rim joint 21 connected to the radial members 6.

The said 12 m diameter preloaded parabolic dish antenna consists of 24 radial tubular members 6 and has a focal length of 4.8 m (FIG. 3). The said 12 m dish has been designed for a survival wind velocity of 150 kmph. The radial members 6 are connected to a hub 5 of 4 m diameter made out of welded mild steel plates of 10 mm thickness and its cross-section has a width $w_1$=200 mm and height of H=200 mm. (FIG. 5). The radius of the inner ring 9, hub 5, intermediate circumferntial bracing ring 13 and outer circumferntial ring (rim) 12 are 600 mm, 2000 mm, 4000 mm and 6000 mm respectively (FIG. 4). In FIG. 4 the dotted line shows schematically location and inclination of the radial members before their elastic bending; the broken line elastically bent radial tube 6 and the full line the required parabola. It is found that the deviation of the curved radial members 6 from the parabola lies within ±40 mm, which can be compensated by using adjustable bolts 31 as shown in FIG. 16. The radial, rim and bracing members consist of high tensile seamless tubes of 40 mm diameter and 8 mm wall thickness, with a yield strength of 60 kg/mm$^2$. Alternatively tubes of 50 mm dia and 6 mm thickness may also be used. Quadripod consists of seamless tubes of 50 mm dia and 8 mm wall thickness. The reflecting panels are made of stainless steel welded wire mesh with a size of 6 mm×6 mm (distance between adjacent wires of 6 mm) and wire diameter of 0.55 mm (FIGS. 14 & 15)

The total weight of the 12 m diameter preloaded parabolic dish including weight of the hub, various structural members, clamps and joints and the reflecting panels is about 2.5 tonnes. For wind velocity of 150 kmph, the dish is subject to a wind force of 2.7 tonnes when facing to horizon and the wind torque about the elevation axis is 3.5 tonne-m. The dead load torque about the elevation axis is 4.7 tonne-m, before balancing of the dish by a counter weight. The frequency of the lowest vibrational mode is 1.5 Hz.

Calculations have also been made for a preloaded parabolic dish antenna of 25 m diameter for a survival wind velocity of 140 kmph. The 25 m dish has a total weight of 14 tonnes, wind force (horizon) 13 tonnes, wind torque about elevation axis of 19 tonne-m and dead load torque (before balancing) of 42 tonne-m. These weights and torques are much lower than those for conventional dishes.

Thus it has been shown that application of preload to the structural members as well as the selection of an optimum configuration results in considerable reduction in the weight and wind torques on the drive system of a parabolic dish and minimizes the labour required for assembly including welding and bolting of various structural members compared to that of a conventional back up structure, thus leading to considerable economy. These concepts are useful and applicable not only for designing back-up structure of the parabolic dishes but also for a wide variety of similar 3 dimensional structures, e.g. a fixed spherical reflector antenna placed above ground.

While we have illustrated and described the preferred embodiments of our invention using the example of a 12 m diameter preloaded parabolic dish antenna, it is to be understood that these are capable of variation and modification, and we therefore do not wish to be limited to the precise details set forth, but desire to avail ourselves of such changes and alterations as fall within the purview of the following claims.

What is claimed is:

1. A back-up structure for parabolic dish antenna comprising:

a central hub;

an assembly of plurality of radial structural members connected to the central hub on one end and spread out radially from the hub in an umbrella like configuration and extending to a circular rim at the end away from the hub, each said radial structural members obtained of material of high tensile strength and as a single piece structural unit which is elastically bent and bowed to define a substantially parabolic pre-stressed structure;

a plurality of structural rim members connected rigidly to the radial members towards the rim end thereof;

a plurality of bracing members disposed at intermediate locations on the radial structural members between the hub and the rim ends, said bracing members being substantially parallel to the structural rim members;

said radial members, rim members and bracing members tensioned to specific selective stress values such as to thereby store desired internal elastic strain energy to resist gravitational and static and dynamic wind forces.

2. A method of fabrication of back-up structure, the method comprising the steps of:

providing a central hub;

connecting one end of plurality of high tensile strength radial structural members to the central hub;

elastically bending and bowing each of the radial structural members along its free ends by applying a selective preload to define a substantially parabolic pre-stressed structure;

connecting the pre-stressed radial member by straight structural rim members at its free ends and intermediate bracing members at intermediate locations on the radial structural members between the hub and the rim end, said bracing members being positioned parallel to said structural rim members;

said radial members, rim members and bracing members tensioned to selective stress values such as to thereby store desired internal elastic stress energy to resist gravitational and static and dynamic wind forces.

3. A method as claimed in claim 2, wherein radial structural members are formed by fixing straight radial members at a suitable location and inclination angle at the central hub with respect to its plane and then applying a force with a normal component at their tips for achieving the desired curvature.

4. A method as claimed in claim 2, wherein the required curvature of the radial members is formed by pre-bending them slightly with the curvature of a relatively large radius, before fixing of the curved radial members at a suitable inclination angle at the central hub and then applying a normal force at their tips for achieving the desired curvature.

5. A method as claimed in claim 2, wherein the curvature in the radial directions is formed by elastically bending the radial members firstly from the hub to an intermediate portion and thereafter bending from the intermediate portion to the outer rim using suitable tensioning devices.

6. A method as claimed in claim 2, wherein the required initial prestress in the radial structural members is imparted by tensioning devices using steel ropes and turnbuckles, connected to a temporarily erected ring-plate and/or a central tower with suitable attachments.

7. A method as claimed in claim 2, wherein the required initial prestress in the radial structural members is imparted by tensioning devices such as jacks placed near the tip of each of the radial members or pulling devices attached to the roof of a shed in case the dish is assembled in a shed or a building.

8. A method as claimed in claim 2, wherein the initial prestress in the circumferentially placed rim and bracing members is achieved by rigidly bolting or riveting or welding all the structural members using appropriate clamps and joints before removing the said tensioning devices.

9. A method as claimed in claim 2, in which the diameter of the hub, number of radial members, dimensions and tensile strength and material of the radial, rim and bracing structural members are appropriately selected, and the inclination angle of the radial members and their suitable placement at the hub before their elastic bending are suitably chosen so as to storing sufficient stress energy in the structural members, so that their stresses remain within the required bounds for the conditions of the survival wind velocity.

10. A method as claimed in claim 2, in which the dimensions of the radial structural members, rim members and bracing members of the intermediate circumferential rings including connection of a suitable number of intermediate rings and/or using diagonally placed structural bracing members are appropriately selected, and if also required, additional non-conductive ropes made of materials such as Kevlar across the dish so as to obtain sufficient stiffness of the preloaded parabolic dish for minimizing any adverse effects due to the vibrational modes of the dish.

11. A preloaded parabolic dish antenna comprising:

(a) a back-up structure, wherein the back-up structure comprises a central hub, an assembly of plurality of high tensile strength radial structural members connected to the central hub on one end and spread out radially from the hub in an umbrella like configuration and extending to a circular rim at the end away from the hub, each said radial structural members obtained of material of high tensile strength and as a single piece structural unit which is elastically bent and bowed to define a substantially parabolic pre-stressed structure, a plurality of structural rim members connected rigidly to the radial members towards the rim end thereof, a plurality of bracing members disposed at intermediate locations on the radial structural members between the hub and the rim ends, said bracing members being substantially parallel to the structural rim members, said radial members, rim members and bracing members tensioned to specific selective stress values such as to thereby store desired internal elastic strain energy to resist gravitational and static and dynamic wind forces;

(b) a reflecting surface, said reflecting surface attached to the said radial structural members and being provided with metallic or metallized reflector panels of specified tolerances, and (c) a structure for supporting electronic units at the focus, (d) said parabolic dish having sufficient stiffness such that the lowest frequency of various vibrational modes exceeds about 1.5 or 2 Hz in order to provide safety in the presence of dynamic wind forces, such as gustiness of the wind.

12. A method for the fabrication of the preloaded parabolic dish antenna, the method comprising the step of:

(a) providing the back-up structure, wherein the back-up structure is produced by providing a central hub, connecting one end of plurality of high tensile strength radial structural members to the central hub, elastically bending and bowing each of the radial structural members along its free ends by applying a selective preload to define a substantially parabolic pre-stressed structure, connecting the pre-stressed radial members by straight structural rim members at its free ends and intermediate bracing members at intermediate locations on the radial structural members between the hub and the rim end, said bracing members being positioned parallel to said structural rim members, said radial members, rim members and bracing members tensioned to selective stress values such as to thereby store desired internal elastic stress energy to resist gravitational and static and dynamic wind forces;

(b) providing reflector panels having reflecting elements and attaching the said panels to the said radial structural members in order to thereby obtain a reflecting surface, said reflector panels being of predetermined tolerences;

(c) providing a structure suitable for supporting electronics units at the focus to thereby obtain a parabolic dish antenna;

(d) subjecting said parabolic dish to a suitable treatment so as to impart sufficient stiffness such that the lowest frequency of various vibrational modes exceeds about 1.5 or 2 Hz in order to provide safety in the presence of dynamic wind forces, such as gustiness of the wind.

13. A method as claimed in claim 12, wherein said reflector panels of light weight and low wind loading are fabricated by fixing welded wire mesh of appropriate mesh size and made of stainless steel wires of suitable diameter or woven mesh made of reflecting fibers, depending upon the shortest wavelength of operation of the parabolic dish, with the wire mesh attached to a rigid frame.

14. A method as claimed in claim 12, wherein the reflector panels are made of solid or perforated metal or metallized-plastic sheets using conventional design.

15. A method as claimed in claim 12, wherein the parabolic dish antennas have diameter in the range of about 5 m to 100 m and a suitable focal length as required for an application for receiving and/or transmitting radio waves.

16. A back-up structure for parabolic dish antenna comprising:

a central hub;

an assembly of plurality of radial structural members connected to the central hub on one end and spread out radially from the hub in an umbrella like configuration and extending to a circular rim at the end away from the hub, each said radial structural members form of a material having a tensile strength of at least 60 kg/mm$^2$ and as a single piece structural unit which is elastically bent and bowed to define a substantially parabolic pre-stressed structure;

a plurality of structural rim members connected rigidly to the radial members towards the rim end thereof;

a plurality of bracing members disposed at intermediate locations on the radial structural members between the hub and the rim ends, said bracing members being substantially parallel to the structural rim members;

said radial members, rim members and bracing members tensioned to specific selective stress values such as to thereby store desired internal elastic strain energy to resist gravitational and static and dynamic wind forces.

* * * * *